US005496693A

United States Patent [19]

Yoshioka et al.

[11] Patent Number: 5,496,693

[45] Date of Patent: Mar. 5, 1996

[54] SILVER HALIDE COLOR PHOTOGRAPHIC MATERIAL

[75] Inventors: Yasuhiro Yoshioka; Kohzaburoh Yamada; Kiyoshi Takeuchi, all of Kanagawa, Japan

[73] Assignee: Fuji Photo Film Co., Ltd., Minami Ashigara, Japan

[21] Appl. No.: 333,347

[22] Filed: Nov. 2, 1994

Related U.S. Application Data

[62] Division of Ser. No. 52,708, Apr. 27, 1993, Pat. No. 5,409, 807.

[30] Foreign Application Priority Data

Apr. 28, 1992 [JP] Japan ..... 4-134519

[51] Int. Cl.[6] ..... G03C 7/388; G03C 7/36

[52] U.S. Cl. ..... 430/545; 430/546; 430/557; 430/631

[58] Field of Search ..... 430/546, 545, 430/631, 557

[56] References Cited

U.S. PATENT DOCUMENTS

| | | | |
|---|---|---|---|
| 4,668,611 | 5/1987 | Nakamura et al. | 430/507 |
| 4,770,983 | 9/1988 | Ogawa et al. | 430/505 |
| 5,001,045 | 3/1991 | Furutachi et al. | 430/545 |
| 5,028,519 | 7/1991 | Norigaki et al. | 430/551 |
| 5,071,738 | 12/1991 | Mizukura et al. | 430/546 |
| 5,100,771 | 3/1992 | Mihayashi et al. | 430/546 |
| 5,213,958 | 5/1993 | Motoki et al. | 430/557 |
| 5,294,527 | 3/1994 | Deguchi | 430/545 |
| 5,328,817 | 7/1994 | Nakagawa et al. | 430/503 |

*Primary Examiner*—Lee C. Wright
*Attorney, Agent, or Firm*—Burns, Doane, Swecker & Mathis

[57] ABSTRACT

A silver halide color photographic material excellent in color reproducibility, color forming property, color image fastness and processing dependency. The material comprises a yellow color forming silver halide emulsion layer formed on a support, said layer containing at least one yellow color forming coupler represented by general formula (I) dispersed by dissolution in a high boiling organic solvent in a weight ratio of the high boiling organic solvent to the yellow color forming coupler of 0.6 or more:

(I)

wherein X represents an organic residue necessary for forming a nitrogen-containing heterocycle with a nitrogen atom; Y represents an aromatic group or a heterocyclic group; Z represents a group which is eliminatable by reaction of the coupler represented by general formula (I) with an oxidation product of a developing agent.

13 Claims, No Drawings

SILVER HALIDE COLOR PHOTOGRAPHIC MATERIAL

This application is a divisional, of application Ser. No. 08/052,708, filed Apr. 27, 1993 now U.S. Pat. No. 5,409, 807.

FIELD OF TEE INVENTION

The present invention relates to a silver halide color photographic material, and particularly to a silver halide color photographic material containing a novel yellow color forming coupler (hereinafter referred to as a yellow coupler). The material can provide improved color reproducibility, color image fastness to light and heat, and processing dependency.

BACKGROUND OF TEE INVENTION

Silver halide color photographic materials are subjected to color development after exposure, which allows dye forming couplers to react with oxidation products of aromatic primary amine developing agents and form color images.

In this method, the color images are generally reproduced by the subtractive color process. In this process, couplers for forming yellow, magenta and cyan dyes are used Which are dispersed in silver halide emulsion layers different in color sensitivity. Of these couplers, acylacetanilide-type couplers such as pivaloyl-type yellow couplers, and benzoyl-type yellow couplers and malondianilide-type couplers are widely known as the yellow couplers.

The pivaloyl-type yellow couplers can provide excellent hue and color image fastness, and have been used mainly in color print materials. However, they exhibit the disadvantage of low molecular extinction coefficients and low coupling activities. Also with respect to hue and color image fastness, further developments have been desired to meet recently higher demands.

The benzoyl-type yellow couplers have been used mainly in negative films for shooting, because of their high molecular extinction coefficients and high activities. However, they are broad in their absorption wave forms and provide low fastness of formed dye images, such that further developments have also been desired.

The malondianilide-type yellow couplers are described, for example, in U.S. Patents 4,149,886, 4,095,984 and 4,477,563. They are inferior to the above-described benzoyl-type couplers in hue and image fastness. Therefore, they are only used as couplers of the development inhibitor releasing-type and have limited applications.

Couplers in which the disadvantages of the malondianilide-type couplers have been improved are described in European Patent 447020A1. However, even those couplers have not reached a fully satisfactory level in all of the color forming properties, hue and color image fastness.

There is a strong desire to develop couplers having a satisfactory combination of high molecular extinction coefficient, high color forming properties, excellent hue and the excellent color image fastness.

Various uses of high boiling organic solvents, antifading agents and color forming accelerators have been studied to compensate for the disadvantages of the yellow couplers of the types described above. For example, methods for improving the hue by use of high boiling organic solvents are described in JP-A-63-241547 (the term "JP-A" as used herein means an "unexamined published Japanese patent application") and JP-A-63-256952, and methods for improving color image fastness are described in U.S. Pat. No. 4,745,049, JP-A-64-11262, JP-A-64-17056, JP-A-64-10247, JP-A-64-50048 and JP-A-2-4239. Methods for improving color image fastness by use of antifading agents are described, for example, in JP-A-61-2151, JP-A-61-6652, JP-A-l-196049 and JP-A-1-284853. Further, methods using water-insoluble, organic solvent-soluble polymers to improve the color image fastness are described in JP-A-64-50049.

However, materials or methods which can fully meet increasingly heightened demands have not yet been reached, even by the above-described methods. Further improvements in couplers, or techniques for use thereof, are still strongly desired.

SUMMARY OF TEE INVENTION

Therefore, an object of the present invention is to develop a novel yellow coupler having a combination of a high molecular extinction coefficient, high color forming properties, excellent hue and excellent color image fastness, and to provide a silver halide color photographic material which provides excellent color reproducibility, color image fastness and processing dependency using that coupler.

The above-described object of the present invention can be obtained by the silver halide color photographic materials described below. In a first embodiment there is provided a silver halide color photographic material comprising a yellow color forming silver halide emulsion layer formed on a support, said layer containing at least one yellow color forming coupler represented by the following general formula (I) dispersed by dissolution in a high boiling organic solvent in a weight ratio of the high boiling organic solvent to the yellow color forming coupler of 0.6 or more:

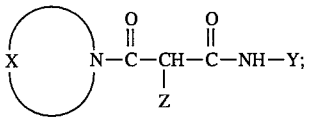

(I)

wherein X represents an organic residue necessary for forming a nitrogen-containing heterocycle with a nitrogen atom; Y represents an aromatic group or a heterocyclic group; Z represents a group which is eliminatable by reaction of the coupler represented by general formula (I) with an oxidation product of a developing agent; and

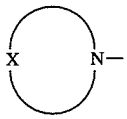

is hereinafter referred to as A.

In a preferred embodiment, the high boiling organic solvent has a dielectric constant of 6.0 or less.

In an even more preferred embodiment, the high boiling organic solvent is represented by one of the following general formulae (S-1) to (S-5):

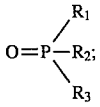

(S-1)

-continued

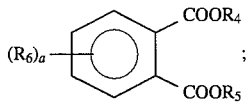

(S-2)

$$(Ar-COO)_b R_7; \quad \text{(S-3)}$$

$$(R_8-COO)_c R_9; \text{ and} \quad \text{(S-4)}$$

$$R_{10}(COO-R_{11})_d. \quad \text{(S-5)}$$

In formula (S-1), $R_1$, $R_2$ and $R_3$ each independently represents an alkyl group, a cycloalkyl group, an aryl group, an alkoxy group, a cycloalkyloxy group or an aryloxy group. In formula (S-2), $R_4$ and $R_5$ each independently represents an alkyl group, a cycloalkyl group or an aryl group, $R_6$ represents a halogen atom such as F, Cl, Br or I, an alkyl group, an alkoxy group, an aryloxy group or an alkoxycarbonyl group, and a represents an integer of 0 to 3, with the proviso that when a is 2 or more, a plurality of $R_6$s may be the same or different. In formula (S-3), Ar represents an aryl group, b represents an integer of 1 to 6, and $R_7$ represents a b-valent hydrocarbon group or a hydrocarbon group bonded through an ether linkage to each other. In formula (S-4), $R_8$ represents an alkyl group or a cycloalkyl group, c represents an integer of 1 to 6, and $R_9$ represents a c-valent hydrocarbon group or a hydrocarbon group bonded through an ether linkage. In formula (S-5), d represents an integer of 2 to 6, $R_{10}$ represents d-valent hydrocarbon group (excluding an aromatic group), and $R_{11}$ represents an alkyl group, a cycloalkyl group or an aryl group.

In another embodiment, the yellow color forming silver halide emulsion layer contains a water-insoluble polymer.

In even another embodiment, the weight ratio of the water-insoluble polymer to the yellow coupler in the yellow color forming silver halide emulsion layer is 0.2 or more.

In a further embodiment, at least one cyan color forming silver halide emulsion layer, at least one magenta color forming silver halide emulsion layer and at least one of said yellow color forming silver halide emulsion layer, which are different from one another in color sensitivity, are formed on the support.

DETAILED DESCRIPTION OF THE INVENTION

In the couplers represented by general formula (I) the nitrogen-containing heterocycle represented by A has one or more carbon atoms, preferably 1 to 20 carbon atoms, and more preferably 2 to 12 atoms, and may be saturated or unsaturated, a single ring or a condensed ring, and substituted or unsubstituted. The ring may contain an oxygen atom, a sulfur atom or a phosphorus atom in addition to the nitrogen atom. More than one atom may be contained in each of these heteroatoms. The number of the ring members is 3 or more, preferably 3 to 12, and more preferably 5 or 6.

Specific examples of the heterocycles represented by A include pyrrolidino, piperidino, morpholino, 1-imidazolidinyl, 1-pyrazolyl, 1-piperazinyl, 1-indolinyl, 1,2,3,4-tetrahydroquinoxaline-1-yl, 1-pyrrolinyl, pyrazolidine-1-yl, 2,3-dihydro-1-indazolyl, isoindoline-2-yl, 1-indolyl, 1-pyrrolyl, benzothiazine-4-yl, 4-thiazinyl, benzodiazine-1-yl, aziridine-1-yl, benzooxazine-4-yl, 2,3,4,5-tetrahydroquinolyl and phenoxazine-10-yl.

In general formula (I), the aromatic group represented by Y has 6 or more carbon atoms, and preferably 6 to 10 carbon atoms, and may be substituted or unsubstituted. Particularly preferred examples of such aromatic groups include phenyl and naphthyl.

In general formula (I), the heterocyclic group represented by Y has one or more carbon atoms, preferably 1 to 10 carbon atoms, and more preferably 2 to 5 carbon atoms, and may be saturated or unsaturated, and substituted or unsubstituted. Preferred examples of the heteroatoms include a nitrogen atom, a sulfur atom and an oxygen atom. The number of the ring members is preferably 5 or 6, but others may be used. The ring may be either a single ring or a condensed ring. Specific examples of the heterocyclic groups represented by Y include 2-pyridyl, 4-pyrimidinyl, 5-pyrazolyl, 8-quinolyl, 2-furyl and 2-pyrrolyl.

When the groups represented by A and Y in general formula (I) each have substituents, examples of the substituents include halogen atoms such as fluorine and chlorine, alkoxycarbonyl groups having 2 to 30, preferably 2 to 20 carbon atoms, such as methoxycarbonyl, dodecyloxycarbonyl and hexadecyloxycarbonyl groups, acylamino groups having 2 to 30, preferably 2 to 20 carbon atoms, such as acetamido, tetra-decaneamido, 2-(2,4-di-t-amylphenoxy)butaneamido and benzamido groups, sulfonamido groups having 1 to 30, preferably 1 to 20 carbon atoms, such as methanesulfonamido, dodecanesulfonamido, hexadecanesulfonamido and benzenesulfonamido groups, carbamoyl groups having 2 to 30, preferably 2 to 20 carbon atoms, such as N-butylcarbamoyl and N,N-diethylcarbamoyl groups, sulfamoyl groups having 1 to 30, preferably 1 to 20 carbon atoms, such as N-butylsulfamoyl, N-dodecylsulfamoyl, N-hexadecylsulfamoyl and N-3-(2,4-di-t-amylphenoxy)butylsulfamoyl groups, alkoxy groups having 1 to 30, preferably 1 to 20 carbon atoms, such as methoxy and dodecyloxy groups, N-acylsulfamoyl groups having 2 to 30, preferably 2 to 20 carbon atoms, such as N-propanoylsulfamoyl and N-tetradecanoylsulfamoyl groups, sulfonyl groups having 1 to 30, preferably 1 to 20 carbon atoms, such as methanesulfonyl, octanesulfonyl and dodecanesulfonyl groups, alkoxycarbonylamino groups having 1 to 30, preferably 1 to 20 carbon atoms, such as methoxycarbonylamino and tetradecyloxycarbonylamino groups, a cyano group, a nitro group, a carboxyl group, aryloxy groups having 6 to 20, preferably 6 to 10 carbon atoms, such as phenoxy and 4-chlorophenoxy groups, alkylthio groups having 1 to 30, preferably 1 to 20 carbon atoms, such as methylthio and dodecylthio groups, ureido groups having 1 to 30, preferably 1 to 20 carbon atoms, such as a phenylureido group, aryl groups having the same meaning as described when Y represents an aromatic group, heterocyclic groups having the same meaning as described when Y represents a heterocyclic group, a sulfo group, alkyl groups having 1 to 30, preferably 1 to 20 carbon atoms, which are straight, branched, cyclic, saturated, unsaturated, substituted or unsubstituted, such as methyl, ethyl, isopropyl, cyclopropyl, trifluoromethyl, cyclopentyl, dodecyl and 2-hexyloctyl groups, acyl groups having 1 to 30, preferably 2 to 20 carbon atoms, such as acetyl and benzoyl groups, arylthio groups having 6 to 20, preferably 6 to 10 carbon atoms, such as a phenylthio group, sulfamoylamino groups having 0 to 30, preferably 0 to 20 carbon atoms, such as N-butylsulfamoylamino and N-dodecylsulfamoylamino groups, N-acylcarbamoyl groups having 2 to 30, preferably 2 to 20 carbon atoms, such as a N-dodecanoylcarbamoyl group, N-sulfonylcarbamoyl groups having 1 to 30, preferably 2 to 20, carbon atoms, such as N-hexadecanesulfonylcarbamoyl, N-benzenesulfonylcarbamoyl and N-(2-octyloxy-5-tert-octylbenzenesulfonyl)carbamoyl groups, N-sulfamoylcarbamoyl groups having 1 to 30, preferably 1 to 20 carbon atoms, such as N-(ethylsulfamoyl)carbamoyl and N-{3-(2,4-di-t-amylphenoxy)propylsulfamoyl}carbamoyl groups, N-sulfonylsulfamoyl groups having 0 to 30, preferably 1 to 20 carbon atoms, such as N-dodecanesulfonylsulfamoyl and N-benzenesulfonylsulfamoyl groups, N-carbamoylsulfamoyl groups having 1 to 30, preferably 1 to 20 carbon atoms, such as N(ethylcarbamoyl)sulfamoyl and N-{3-(2,4-di-t-amyl-phenoxy)propylcarbamoyl}sulfamoyl groups, N-(N-sulfonylcarbamoyl)sulfamoyl groups having 1 to 30, preferably 1 to 20 carbon atoms, such as N-(dodecanesulfonylcarbamoyl)sulfamoyl and N-(2-octyloxy-5-t-octylbenzenesulfonylcarbamoyl)sulfamoyl groups, 3-sulfonylureido groups having 1 to 30, preferably 1 to 20 carbon atoms, such as 3-hexadecanesulfonylureido and 3-benzenesulfonylureido groups, 3-acylureido groups having 2 to 30, preferably 2 to 20 carbon atoms, such as 3-acetylureido and 3-benzoylureido groups, 3-acylsulfamido groups having 1 to 30, preferably 1 to 20 carbon atoms, such as 3-propionylsulfamido and 3-(2,4-dichlorobenzoyl-)sulfamido groups, 3-sulfonylsulfamido groups having 0 to 30, preferably 1 to 20 carbon atoms, such as 3-methanesulfonylsulfamido and 3-(2-methoxyethoxy-5-t-octylbenzenesulfonyl)sulfamido groups, a hydroxyl group, acyloxy groups having 1 to 30, preferably 1 to 20 carbon atoms, such as propanoyloxy and tetradecanoyloxy groups, sulfonyloxy groups having 0 to 30, preferably 0 to 20 carbon atoms, such as dodecanesulfonyloxy and 2-octyl-oxy-5-t-octylbenzenesulfonyloxy groups and aryloxycarbonyl groups having 7 to 20, preferably 7 to 10 carbon atoms, such as a phenoxycarbonyl group.

When the groups represented by A have substituents, preferred examples of the substituents include the halogen atoms, alkoxy groups, acylamino groups, carbamoyl groups, alkyl groups, sulfonamido groups and nitro groups, of the groups enumerated above. However, unsubstituted groups are also preferred examples.

When the groups represented by Y have substituents, preferred examples of the substituents include the halogen atoms, alkoxycarbonyl groups, sulfamoyl groups, carbamoyl groups, sulfonyl groups, sulfonamido groups, acylamino groups, alkoxy groups, aryloxy groups, N-acylcarbamoyl groups, N-sulfonylcarbamoyl groups, N-sulfamoylcarbamoyl groups, N-sulfonylsulfamoyl groups, N-acylsulfamoyl groups, N-carbamoylsulfamoyl groups and N-(N-sulfonylcarbamoyl)sulfamoyl groups.

The group represented by Z in general formula (I) may be any of coupling eliminatable groups previously known. Preferred examples thereof include nitrogen-containing heterocyclic groups which are bonded to coupling positions at the nitrogen atoms, aromatic oxy groups, aromatic thio groups, heterocyclically oxy groups, heterocyclic thio groups, acyloxy groups, carbamoyloxy groups, alkylthio groups and halogen groups. These eliminatable groups may be any of photographic useful groups or precursors thereof such as development inhibitors, development accelerators, desilverization accelerators, fogging agents, dyes, hardening agents, couplers, developing agent oxidation product scavengers, fluorescent dyes, developing agents and electron transfer agents, and non-photographically useful groups.

The nitrogen-containing heterocyclic group represented by Z is preferably a substituted or unsubstituted heterocyclic group of a single or condensed ring. Examples thereof include succinimido, maleinimido, phthalimido, diglycolimido, pyrrolino, pyrazolyl, imidazolyl, 1,2,4-triazole-1-yl (or 4-yl ), 1-tetrazolyl, indolyl, benzopyrazolyl, benzimidazolyl, benzotriazolyl, imidazolidine-2,4-dione-3-yl (or 1-yl), oxazolidine-2,4-dione-3-yl, thiazolidine-2,4-dione-3-yl, imidazoline-2-one-1-yl, oxazoline-2-one-3-yl, thiazoline-2-one-3-yl, benzooxazoline-2-one-3-yl, 1,2,4-triazolidine-3,5-dione-4-yl, 2-pyridone-l-yl, morpholine-3,5-dione-4-yl, 1,2,3-triazole-1-yl and 2-imidazoline-5-one group.

When the heterocyclic groups have substituents, examples of the substituents include the substituents enumerated for the above-described groups represented by A.

Preferred examples of the nitrogen-containing heterocyclic groups represented by include 1-pyrazolyl, imidazolyl, 1,2,3-triazole-l-yl, benzotriazolyl, 1,2,4-triazole-l-yl, oxazolidine-2,4-dione-3-yl, 1,2,4-triazolidine-3,5-dione-4-yl and imidazolidine-2,4-dione-3-yl. These groups may also be substituted.

The aromatic oxy group represented by Z is preferably a substituted or unsubstituted phenoxy group. When the phenoxy group has a substituent, examples of the substituents include the substituents enumerated for the above-described groups represented by Y. Preferred examples thereof include those groups having at least one electron attractive substituent, such as the sulfonyl, alkoxycarbonyl, sulfamoyl, halogen, carboxyl, carbamoyl and nitro groups.

The aromatic thio group represented by Z is preferably a substituted or unsubstituted phenylthio group. When the phenylthio group has a substituent, examples of the substituents include the substituents enumerated for the above-described groups represented by Y. In the case of the phenylthio group, it is preferred that at least one substituent is alkyl, alkoxy, sulfonyl, alkoxycarbonyl, sulfamoyl, halogen, carbamoyl or nitro.

When Z represents the heterocyclic oxy group, the heterocyclic moiety has the same meaning as described above when Y represents a heterocyclic group.

The heterocyclic thio group represented by Z is preferably a 5- or 6-membered unsaturated heterocyclic thio group. Examples thereof include tetrazolylthio, 1,3,4-thiazolylthio, 1,3,4-oxadiazolylthio, 1,3,4-triazolylthio, benzoimidazolylthio, benzothiazolylthio and 2-pyridylthio groups. When these groups have substituents, examples of the substituents include the substituents enumerated for the above-described heterocyclic groups represented by Y. Of those, particularly preferred substituents include aromatic groups, alkyl groups, alkylthio groups, acylamino groups, alkoxycarbonyl groups and aryloxycarbonyl groups.

Examples of the acyloxy group represented by Z include an aromatic acyloxy group having 7 to 11 carbon atoms, and preferably is benzoyloxy group, or an aliphatic acyloxy group having 2 to 20, preferably 2 to 10 carbon atoms, which may have a substituent. Specific examples of the substituents include the substituents enumerated for the above-described aromatic groups represented by Y. It is preferred that at least one substituent is a halogen atom, a nitro group, an aryl group, an alkyl group or an alkoxy group.

The carbamoyloxy group represented by Z is preferably an aliphatic, aromatic, heterocyclic or unsubstituted carbamoyloxy group having 1 to 30 carbon atoms, preferably 1 to 20 carbon atoms. Examples thereof include N,N-diethylcarbamoyloxy, N-phenylcarbamoyl-morpholinocarbonyloxy, 1-imidazolylcarbonyloxy and N,N-dimethylcarbamoyloxy, wherein detailed descriptions of alkyl, aromatic and heterocyclic groups have the same meanings as defined in the above descriptions for Y.

The alkylthio group represented by Z preferably has 1 to 30 carbon atoms, preferably 1 to 20 carbon atoms. Details of the alkylthio group are the same as defined in the above description for Y.

Preferred examples of the groups represented by Z in general formula (I) include 5- or 6-membered nitrogen-containing heterocyclic groups which are bonded to coupling positions at the nitrogen atoms, aromatic oxy groups, 5- or 6-membered heterocyclic oxy groups and 5- or 6-membered heterocyclic thio groups.

The groups represented by Y in general formula (I) are preferably aromatic groups. A phenyl group having at least one substituent at the ortho position is particularly preferred. Examples of the substituents include the substituents mentioned for the abovedescribed aromatic groups represented by Y.

When the group represented by Y in general formula (I) is the phenyl group having at least one substituent at the ortho position, a halogen atom, an alkoxy group, an alkyl group or an aryloxy group is particularly preferred as the substituent at the ortho position.

Of the couplers represented by general formula (I), particularly preferred couplers are represented by the following general formula (II):

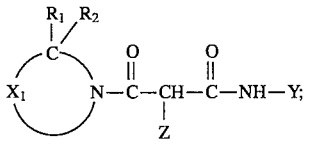

(II)

wherein Y and Z have the same meanings as described in general formula (I); $X_1$ represents an organic residue necessary for forming a nitrogen-containing heterocycle with —C($R_1R_2$)—N—; $R_1$ and $R_2$ each represents a hydrogen atom or a substituent; and

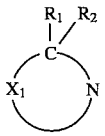

is hereinafter referred to as B.

Preferred examples and specific examples of Y and Z are the same as described above for general formula (I).

Specific examples of the heterocyclic groups represented by B in general formula (II), add examples of the substituents thereof, include the heterocyclic groups and substituents described for A in general formula (I). Preferred examples thereof are also the same as described for A in general formula (I). It is particularly preferred that these nitrogen-containing heterocyclic groups are benzene condensed rings.

Of the couplers represented by general formula (II), more preferred couplers are represented by the following general formula (III):

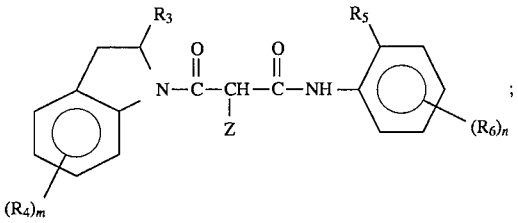

(III)

wherein $R_3$ represents a hydrogen atom or a substituent; $R_4$, $R_5$ and $R_6$ represent substituents; Z has the same meaning as described for general formula (I); m and n each represent an integer of 0 to 4; with the proviso that when m and n each represent an integer of 2 or more, $R_4$ and $R_6$, which may be the same or different, may combine to form a ring.

Examples of the substituents represented by $R_3$ and $R_4$ in general formula (III) are the same as the examples of the substituents of the groups represented by A in general formula (I). Preferred examples of the groups represented by $R_3$ include hydrogen, alkoxy and aryl, and preferred examples of the groups represented by $R_4$ include halogen, alkoxy, acylamino, carbamoyl, alkyl, sulfonamido and nitro. m is preferably an integer of 0 to 2, more preferably, 0 or 1.

Examples of the substituents represented by $R_5$ and $R_6$ in general formula (III) include the same examples as described for the substituents of the groups represented by Y in general formula (I). $R_5$ is preferably halogen, alkoxy, alkyl or aryloxy. Preferred examples of the groups represented by $R_6$ include the same examples as described for the preferred substituents of the groups represented by Y in general formula (I). n is preferably an integer of 0 to 2, more preferably, 1 or 2.

The couplers represented by general formulae (I), (II) and (III) may combine at X, Y and Z through divalent or higher valent groups to form dimers or polymers. In this case, the number of the carbon atoms may be excluded from the range defined above for each of the substituents.

Specific examples of the couplers represented by general formula (I) include, but are not limited to, the following compounds.

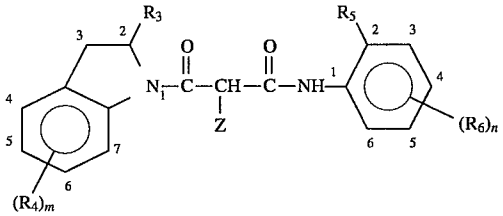
| No. | $R_3$ | m | $R_4$ | $R_5$ | n | $R_6$ | Z |
|---|---|---|---|---|---|---|---|
| 1 | H | 0 | — | $-OCH_3$ | 1 | $-5-SO_2NHCOCH(C_7H_{15})C_9H_{19}$ | 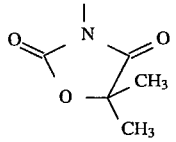 |
| 2 | " | " | — | $-OC_{18}H_{37}(n)$ | 1 | $-5-SO_2NHCOCH(C_2H_5)C_4H_9$ | " |
| 3 | " | " | — | $-OC_{12}H_{25}(n)$ | 1 | $-5-SO_2NHCONHC_3H_7$ | " |
| 4 | " | " | — | $-O-CH_2CH(C_6H_{13}(n))-C_8H_{17}(n)$ | 1 | $-5-SO_2NHCOCH(C_2H_5)C_4H_9$ | " |
| 5 | H | 0 | — | $-O-CH(CH_3)COOC_{12}H_{25}(n)$ | 1 | $-5-SO_2NHCOC_2H_5$ | 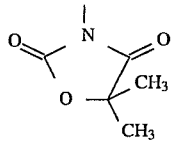 |
| 6 | " | " | — | $-OCH_2CH(CH(CH_3)CH_2C(CH_3)_3)(CH_2)_2CH(CH_3)CH_2C(CH_3)_3$ | 1 | $-5-SO_2NHCOC_2H_5$ | " |
| 7 | " | " | — | $-OCH_2COOCH_2CH(C_{10}H_{21})C_8H_{17}$ | 1 | $-5-SO_2NHCOCH_3$ | " |
| 8 | " | " | — | 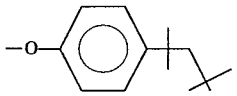 | 1 | $-5-SO_2NHCOCH(C_2H_5)C_4H_9$ | " |

-continued
| | | | | | | | |
|---|---|---|---|---|---|---|---|
| 9 | " | " | — | 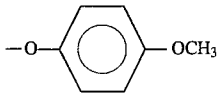 | 1 | 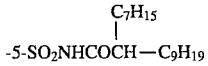 | " |
| 10 | H | 0 | — | 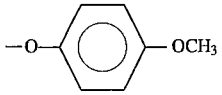 | 1 | -5-$CONHSO_2C_{12}H_{25}$ | 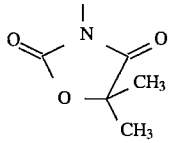 |
| 11 | " | " | — | 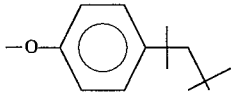 | 1 | -4-$SO_2NHCOC_9H_{19}$ | " |
| 12 | " | " | — | " | 2 | -4-Cl-5-$CONHSO_2C_{16}H_{33}$(n) | " |
| 13 | " | " | — | " | 2 | -3-Cl-5-$CONHCOC_{11}H_{23}$ | " |
| 14 | " | " | — | $-OCH_3$ | 2 | -3-Cl-5-$CONHSO_2C_{12}H_{25}$(n) | " |
| 15 | H | 0 | — | $-OC_{16}H_{33}$(n) | 1 | 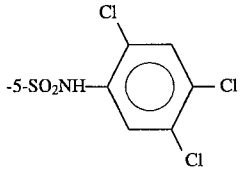 | 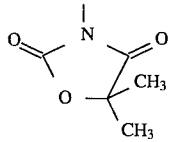 |
| 16 | " | " | — | 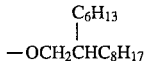 | 1 | 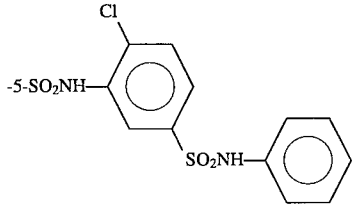 | " |
| 17 | " | " | — | $-OCH(CH_3)_2$ | 1 | 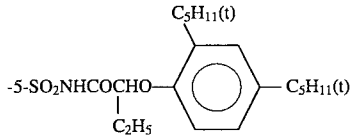 | " |

-continued
| | | | | | | | |
|---|---|---|---|---|---|---|---|
| 18 | " | " | — | $-OC_{18}H_{37}(n)$ | 1 | 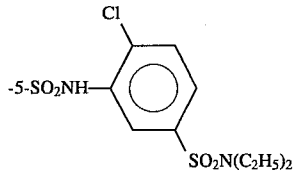 | " |
| 19 | H | 0 | — | 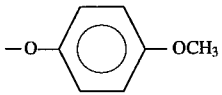 | 1 | 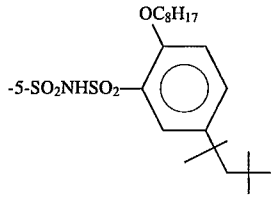 | 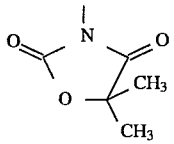 |
| 20 | " | " | — | $-OC_2H_5$ | 1 | " | 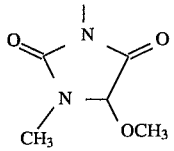 |
| 21 | " | " | — | $-OC_{18}H_{37}(n)$ | 2 | -4-Cl-5-$CONHSO_2C_{12}H_{25}$ | 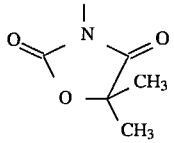 |
| 22 | " | " | — | " | 1 | 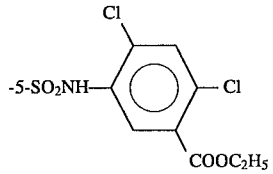 | " |
| 23 | H | 0 | — | 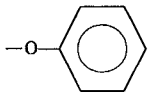 | 1 | 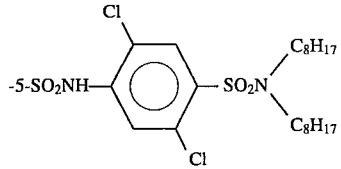 | 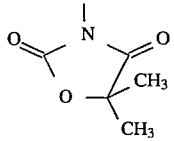 |

-continued
| | | | | | | | |
|---|---|---|---|---|---|---|---|
| 24 | " | " | — | $-OCH(CH_3)_2$ | 1 | 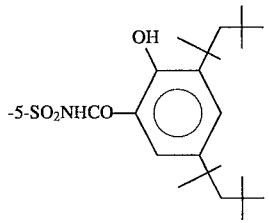 | " |
| 25 | $CH_3$ | " | — | $-OC_2H_5$ | 1 | $-5\text{-}SO_2NHCO\overset{C_7H_{15}}{\overset{\vert}{C}}HC_9H_{19}$ | " |
| 26 | H | " | — | $-OC_{18}H_{37}(n)$ | 1 | 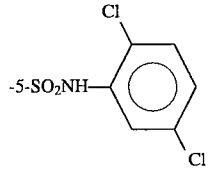 | 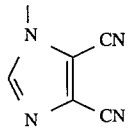 |
| 27 | H | 0 | — | 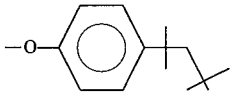 | 1 | 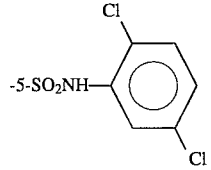 | 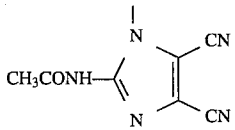 |
| 28 | " | 0 | — | $-OC_{16}H_{33}(n)$ | 1 | $-5\text{-}SO_2NHCOC_2H_5$ | 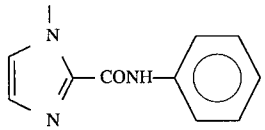 |
| 29 | " | 0 | — | $-Cl$ | 1 | $-5\text{-}CONHSO_2-C_{16}H_{33}(n)$ | 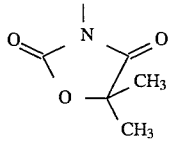 |

-continued
| | | | | | | | |
|---|---|---|---|---|---|---|---|
| 30 | " | 0 | — | " | 1 | -5-NHCO$\underset{\underset{CH_3}{\vert}}{C}$HCH$_2$SO$_2$C$_{12}$H$_{25}$ | 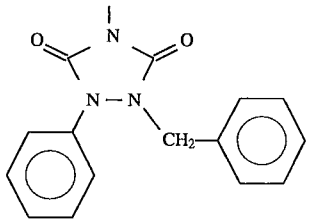 |
| 31 | H | 0 | — | −Cl | 1 | 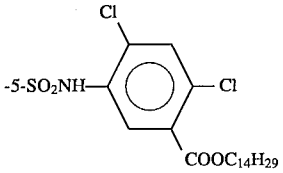 | 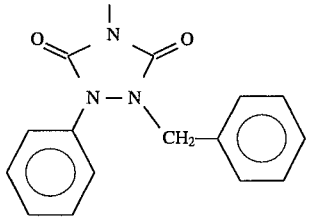 |
| 32 | " | 0 | — | " | 2 | -4-Cl-5-COOC$_{12}$H$_{25}$ | 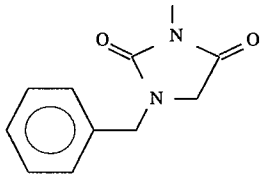 |
| 33 | " | 0 | — | " | 2 | 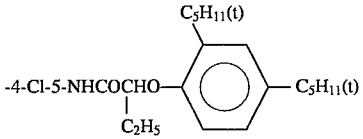 | 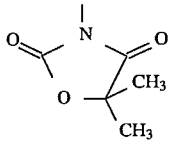 |
| 34 | " | 0 | — | " | 1 | -5-SO$_2$NHC$_{12}$H$_{25}$ | " |
| 35 | " | 0 | — | " | 1 | -5-SO$_2$NHSO$_2$C$_{16}$H$_{33}$(n) | 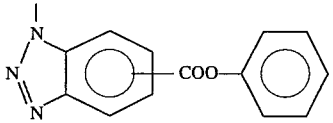 |

-continued
| | | | | | | | |
|---|---|---|---|---|---|---|---|
| 36 | H | 1 | 5-$NO_2$ | $-Cl$ | 1 | 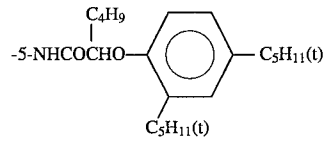 | 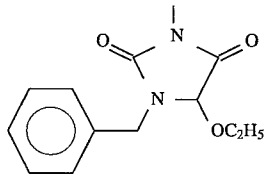 |
| 37 | " | 2 | 5,7-Br | " | 1 | -5-$NHSO_2C_{16}H_{33}$(n) | " |
| 38 | " | 0 | — | $-C_{18}H_{37}$(n) | 1 | 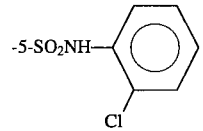 | 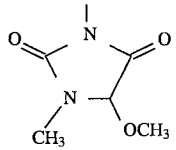 |
| 39 | " | 0 | — | " | 1 | " | 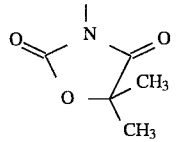 |
| 40 | " | 0 | — | $-OCH_2CH(C_8H_{17})-C_{10}H_{21}$ | 1 | 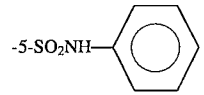 | " |
| 41 | H | 1 | 5-Cl | $-Cl$ | 1 | -5-$NHSO_2C_{16}H_{33}$ | 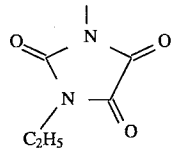 |
| 42 | 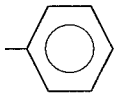 | 1 | 5-$NO_2$ | $-OC_{14}H_{29}$ | 1 | 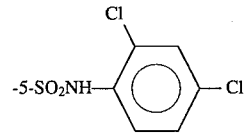 | 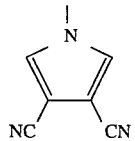 |

-continued
| | | | | | | | |
|---|---|---|---|---|---|---|---|
| 43 | H | 1 | 5-Br | —Cl | 1 | $-5\text{-}COOCH(CH_3)-COOC_{12}H_{25}$ | 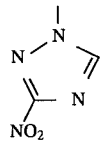 |
| 44 | H | 1 | " | " | 1 | " | 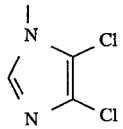 |
| 45 | " | 1 | 5-Cl | " | 1 | $-5\text{-}NHSO_2C_{12}H_{25}$ | 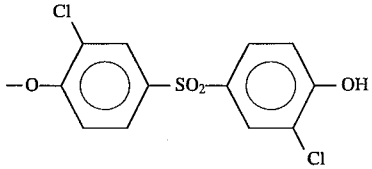 |
| 46 | H | 1 | $5\text{-}NO_2$ | —Cl | 1 | $-5\text{-}NHSO_2C_{12}H_{25}$ | 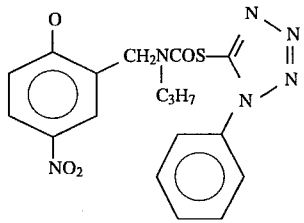 |
| 47 | " | 0 | — | " | 1 | 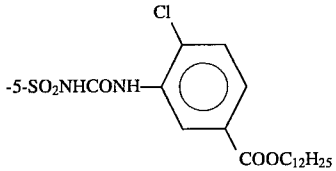 | 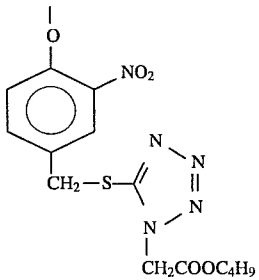 |

-continued
| | | | | | | | |
|---|---|---|---|---|---|---|---|
| 48 | " | 1 | 5-$OCH_3$ | " | 2 | -4-Cl-5-$COOC_{12}H_{25}$ | 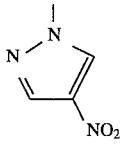 |
| 49 | " | 1 | 5-$NO_2$ | $-CF_3$ | 1 | 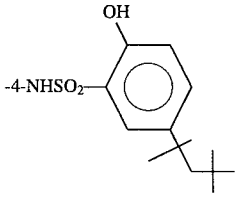 | 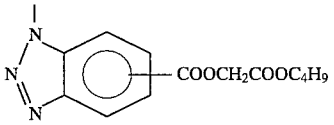 |
| 50 | H | 0 | — | $-OC_2H_5$ | 1 | -5-$SO_2C_{12}H_{25}$ | 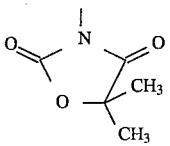 |
| 51 | " | 0 | — | $-Cl$ | 1 | 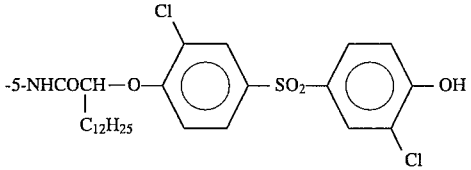 | " |
| 52 | $C_2H_5$ | 0 | — | " | 1 | 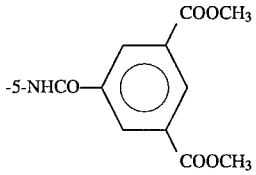 | 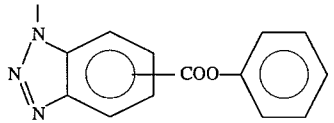 |
| 53 | H | 0 | — | " | 1 | 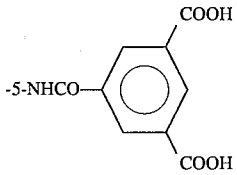 | 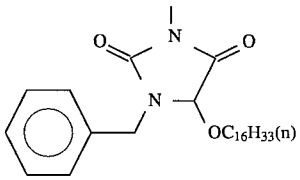 |

-continued
| | | | | | | | |
|---|---|---|---|---|---|---|---|
| 54 | H | 0 | — | Cl | 1 | -5-$SO_2NHCOC_{11}H_{23}$ | 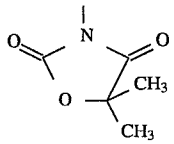 |
| 55 | H | 0 | — | 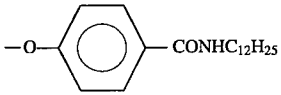 | 1 | 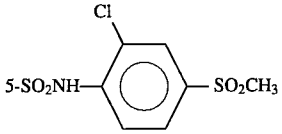 | 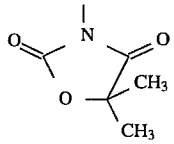 |
| 56 | H | 1 | Br | 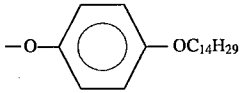 | 1 | 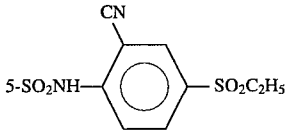 | " |
| 57 | H | 0 | — | 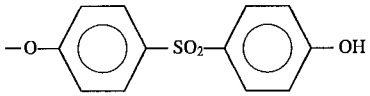 | 1 | 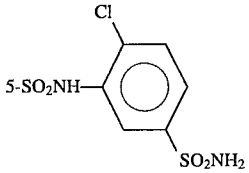 | |
| 58 | H | 0 | — | 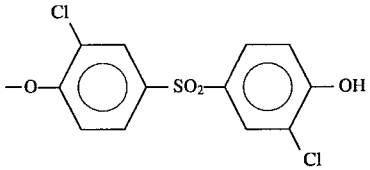 | 1 | 5-$SO_2NHC_{14}H_{29}$ | 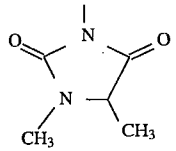 |
| 59 | " | " | — | 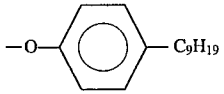 | 1 | 5-$SO_2NHCONHC_{12}H_{25}$ | 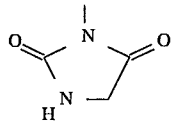 |
| 60 | " | " | — | 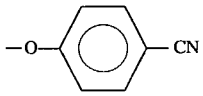 | 1 | 5-$SO_2C_{16}H_{33}$(n) | 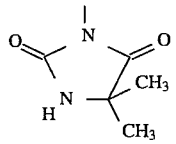 |

-continued
| | | | | | | | |
|---|---|---|---|---|---|---|---|
| 61 | " | " | — | 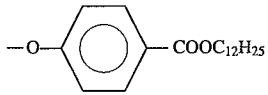 | 1 | 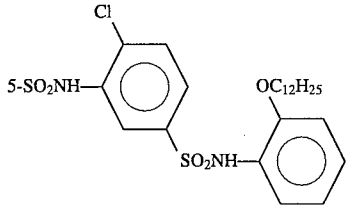 | 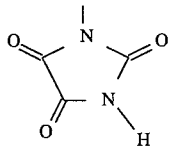 |
| 62 | H | 0 | — | 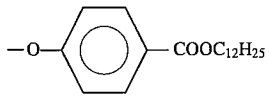 | 1 | 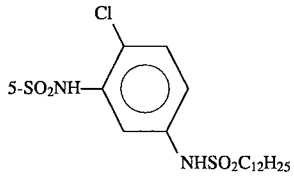 | 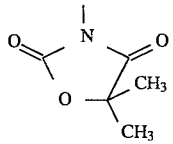 |
| 63 | " | 1 | 5-$NO_2$ | " | 1 | " | 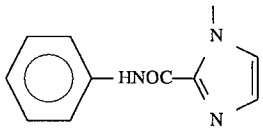 |
| 64 | " | 1 | 5-$NHSO_2CH_3$ | 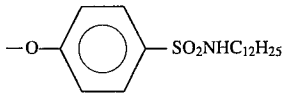 | 1 | 5-$SO_2NH_2$ | 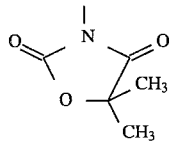 |
| 65 | " | 0 | — | 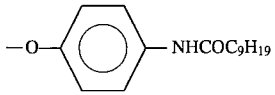 | 2 | 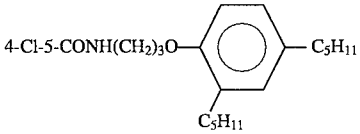 | " |
| 66 | $-CH_3$ | 1 | 5-Br | 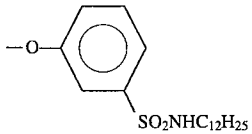 | 1 | 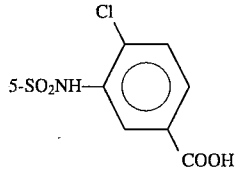 | 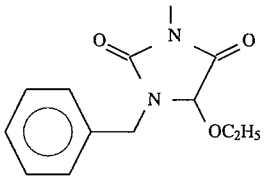 |

-continued
| | | | | | | |
|---|---|---|---|---|---|---|
| 67 | H | 0 | — | 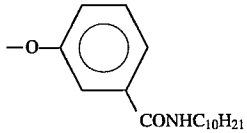 | 1 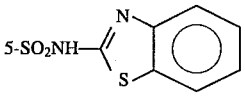 | 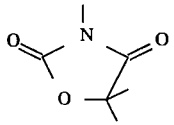 |
| 68 | " | 1 | 5-Br | $-OC_{12}H_{25}$ | 1 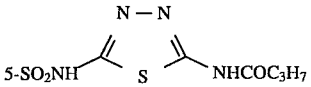 | " |
| 69 | " | 0 | — | 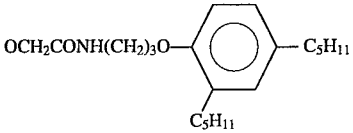 | 1 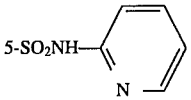 | " |
| 70 | " | 0 | — | 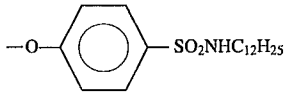 | 1 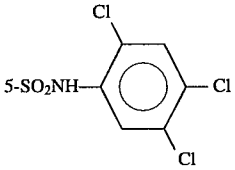 | 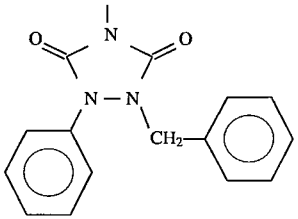 |
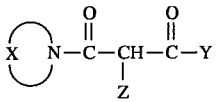
| No. | 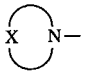 | Y | Z |
|---|---|---|---|
| 71 | 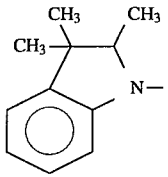 | 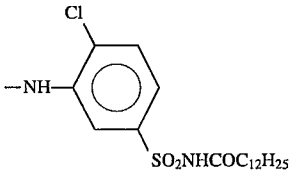 | 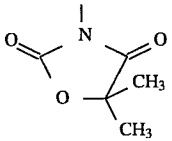 |

-continued
| | | | |
|---|---|---|---|
| 72 | 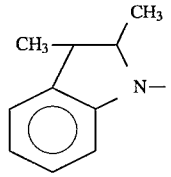 | 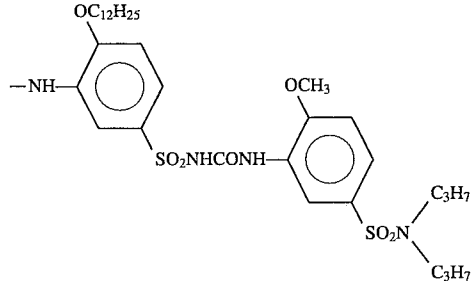 | " |
| 73 | 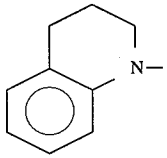 | 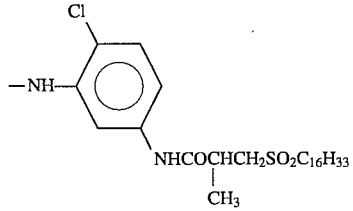 | 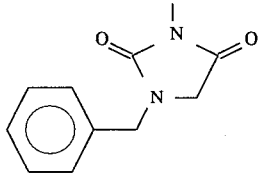 |
| 74 | 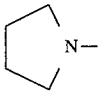 | 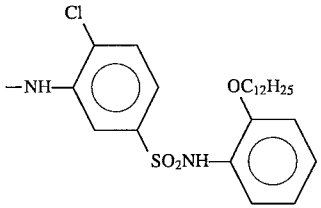 | 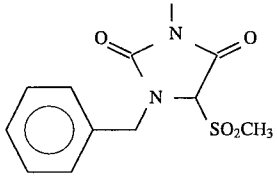 |
| 75 | 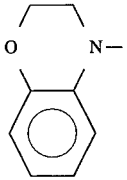 | 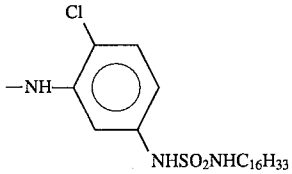 | 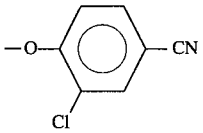 |
| 76 | 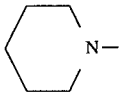 | 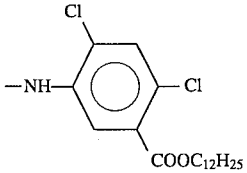 | 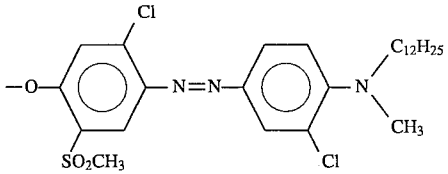 |

-continued
| | | | |
|---|---|---|---|
| 77 | 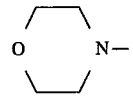 | 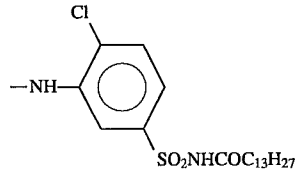 | 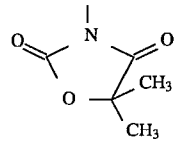 |
| 78 | 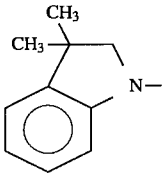 | 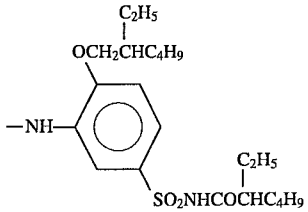 | $SCH_2COOH$ |
| 79 | 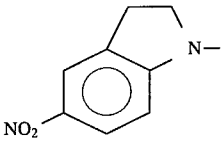 | 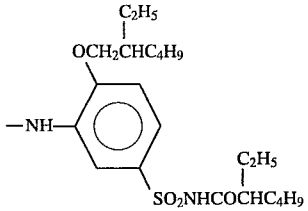 | 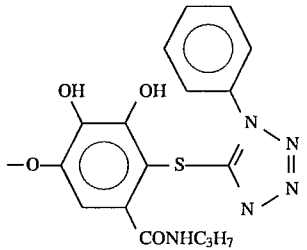 |
| 80 | " | " | 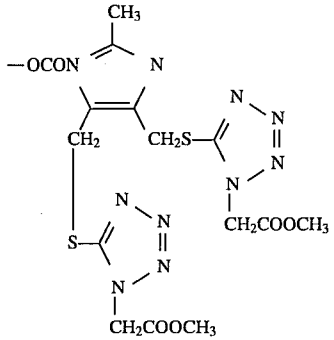 |

-continued
(81)
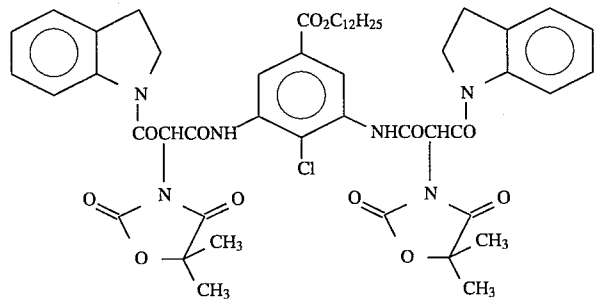
(82)
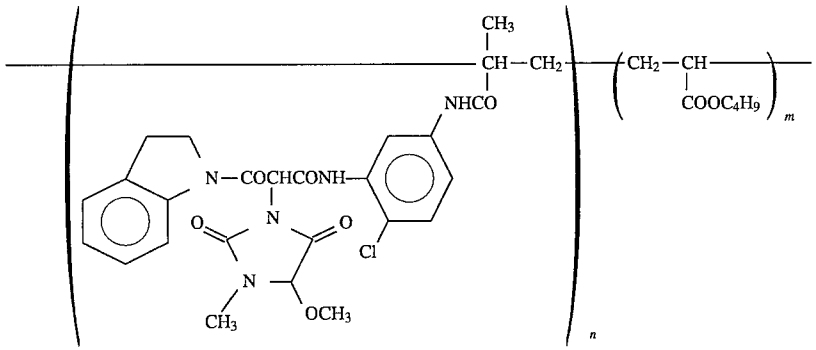
n/m = 50/50 (weight ratio) (average molecular weight: 25,000)

The compounds of the present invention can be synthesized by methods generally known in the art or similar methods.

For example, the compounds can be synthesized by the following synthesis route:

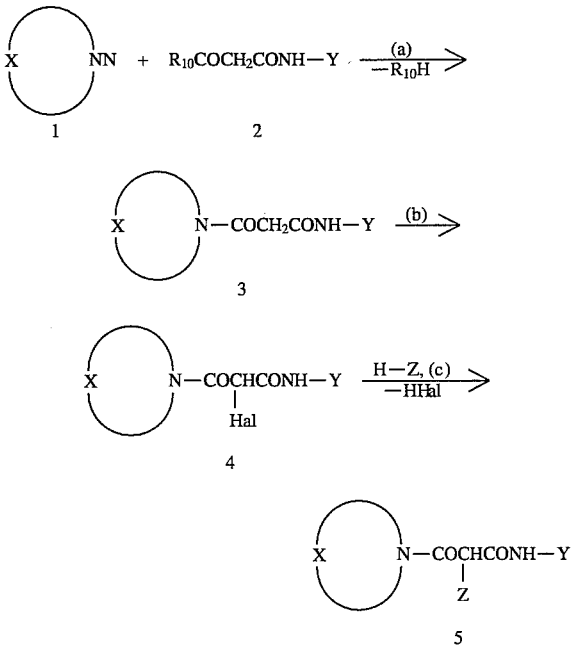

(Compound represented by general formula (I))

In the above synthesis, X, Y and Z have the same meanings as described above for general formula (I); $R_{10}$ represents a halogen atom such as chlorine, —OH, an alkoxy group such as methoxy or ethoxy or a phenoxy group such as phenoxy or 4-nitrophenoxy; and Hal represents a halogen.

Under reaction conditions of (a), when $R_{10}$ is —OH, a dehydrating condensing agent such as N,N-dicyclghexylcarbodiimide or N,N-diisopropylcarbodiimide is used. When $R_{10}$ is a halogen atom, the reaction is conducted in the presence of a dehydrohalogenating agent. The dehydrohalogenating agents used include organic bases such as triethylamine, diisopropylethylamine, pyridine, guanidine and butoxypotassium, and inorganic bases such as sodium hydroxide, potassium hydroxide, sodium hydride and potassium carbonate. In the reaction of compound 3 to compound 4, a halogenating agent is used as (b). Examples of halogenating agents include bromine, chlorine, N-bromosuccinimide and N-chlorosuccinimide. In the reaction of compound 4 to the end product, a dehydrohalogenating agent is generally used as (c). Examples thereof include the organic and inorganic bases described above. In each reaction, a reaction solvent is used. Examples of the solvents include chlorine type solvents such as dichloromethylene, aromatic type solvents such as benzene, chlorobenzene and toluene, amide type solvents such as N,N-dimethylformamide, N,N-dimethylacetamide and N-methylpyrrolidone, nitrile type solvents such as acetonitrile and propionitrile, ether type solvents such as tetrahydrofuran and ethylene glycol diethyl ether, sulfone type solvents such as dimethyl sulfone and sulfolane and hydrocarbon type solvents such as cyclohexane and n-hexane.

The compounds of the present invention can also be synthesized by methods other than the above-described synthesis route. One example is the method described in *J. Org. Chem.*, 29, 2932 (1964). In some cases, product is converted to a desired end product by further conversion of a functional group. The modification of the synthesis route and additional reaction can be appropriately selected.

Specific syntheses are described below. Other example compounds can be synthesized in a similar manner.

SYNTHESIS EXAMPLE 1

Synthesis of Example Compound (54)

Synthesis was conducted by the following method:

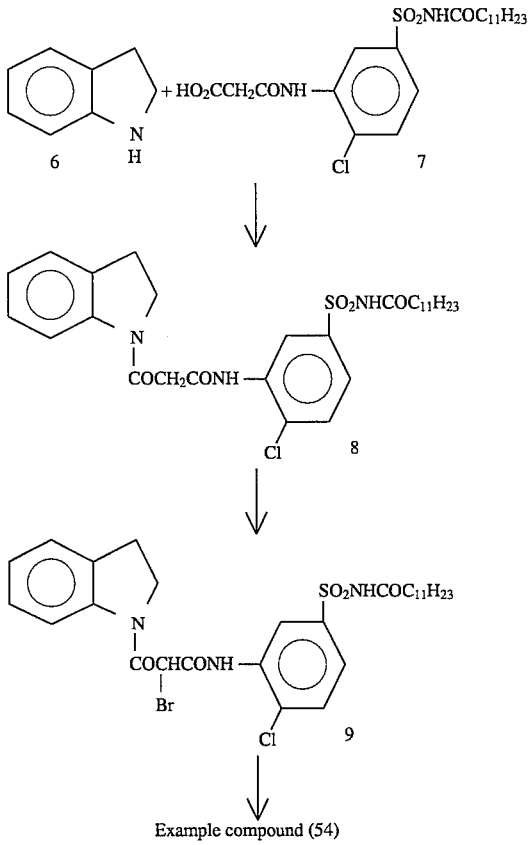

3.5 g of compound (6) and 14 g of compound (7) were dissolved in 100 ml of N,N-dimethylformamide and 0 ml of acetonitrile. To the resulting solution, 40 ml of an acetonitrile solution in which 6 g of N,N'-dicyclohexylcarbodiimide was dissolved, was added dropwise at room temperature. After reaction for 2 hours, precipitated N,N-dicyclohexylurea was separated by filtration. The filtrate was poured on 500 ml of water, and extracted with 500 ml of ethyl acetate. The oil layer was collected using a separatory funnel, and washed with water, followed by drying with Glauber's salt. The solvent was distilled off under reduced pressure, and hexane was added to the residue, followed by crystallization. As a result, 17.2 g of compound (8) was obtained.

16 g of compound (8) was mixed with 150 ml of dichloromethane. 10 ml of dichloromethane solution containing 4.8 g of bromine was added dropwise under ice cooling (5° to 10° C.). After reaction for 10 minutes, the reaction product was transferred into a separatory funnel, and washed with water. The oil layer, a solution containing compound (9), was collected to use in a subsequent step.

8.1 g of 5,5-dimethyl-2,4-dioxo-1,3-oxazolidine and 8.8 ml of triethylamine were added to 160 ml of N,N-dimethylformamide. The dichloromethane solution of compound (9) obtained above was added dropwise to this solution at room temperature. After reaction for 1 hour, 500 ml of ethyl acetate was added. The resulting solution was transferred into a separatory funnel, and washed with water. After neutralization with diluted hydrochloric acid, the solution was washed with water again, and the oil layer was separated. The solvent was distilled off under reduced pressure, and the residue was separated and purified by column chromatography. Silica gel was used as a packing, and ethyl acetate/hexane (1/1) was used as an elute. Fractions containing desired example compound (54) were collected, and the solvent was distilled off under reduced pressure to obtain 15.2 g of waxy example compound (54).

SYNTHESIS EXAMPLE 2

Synthesis of Example Compound (2)

Synthesis was conducted in a manner similar to that of Synthesis Example 1 described above, with the exception that compound (7) was substituted with an equimolar amount of the following compound (10):

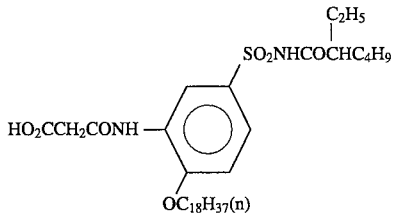

The end product was purified by column chromatography to obtain 18.3 g of waxy example compound (2).

The couplers of the present invention are used preferably in an amount of 0.01 to 10 mmol/m$^2$, more preferably in an amount of 0 05 to 5 mmol/m$^2$ and most preferably in an amount of 0.1 to 3 mmol/m$^2$.

Silver halides are used with respect to the couplers of the present invention in a molar ratio of 0.1 to 100, preferably in a molar ratio of 0.5 to 20, more preferably in a molar ratio of 1.5 to 10, and most preferably in a molar ratio of 2.0 to 6.0.

In the present invention, various conventional dispersing methods can be used to introduce lipophilic photographic organic compounds such as couplers into photographic materials.

According to the oil-in-water dispersion method described in U.S. Pat. No. 2,322,027, the lipophilic photographic organic compounds can be dissolved in high boiling organic solvents having a boiling point of about 175° C. or more at atmospheric pressure such as phthalates, phosphates, benzoates, fatty acid esters, amides, phenols, alcohols, carboxylic acids, N,N-dialkylanilines, hydrocarbons, oligomers and polymers, and/or low boiling organic solvents having a boiling point of about 30° to about 160° C. at atmospheric pressure such as esters (e.g., ethyl acetate, butyl acetate, ethyl propionate, β-ethoxyethyl acetate and methyl cellosolve acetate), alcohols (e.g., sec-butyl alcohol), ketones (e.g., methyl isobutyl ketone, methyl ethyl ketone and cyclohexanone), amides (e.g., dimethylformamide and N-methylpyrrolidone) and ethers (e.g., tetrahydrofuran and dioxane), followed by dispersion by emulsification in hydrophilic colloids such as gelatin.

The high boiling organic solvents used in the present invention may be in any of liquid, waxy and solid forms. As the high boiling organic solvents used for the above-described yellow couplers of the present invention, the high boiling organic solvents having a dielectric constant (25° C., 1 atm., 10 KHz) of 6.0 or less, preferably 3.5 to 5.5, are preferred among others in terms of the best hue of color forming dyes and fastness to light.

Further, with respect to color forming properties and other photographic characteristics, the high boiling solvents represented by any of the above-described general formulae (S-1) to (S-5) are preferably used. For the object of the present invention, the high boiling organic solvents having a dielectric constant of 6.0 or less and represented by any of the above-described general formulae (S-1) to (S-5) are more preferred.

General formulae (S-1) to (S-5) are hereinafter described.

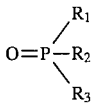

(S-1)

In general formula (S-1), $R_1$, $R_2$ and $R_3$ each independently represents an alkyl group, a cycloalkyl group, an aryl group, an alkoxy group, a cycloalkyloxy group or an aryloxy group.

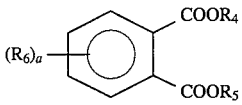

(S-2)

In general formula (S-2), $R_4$ and $R_5$ each independently represents an alkyl group, a cycloalkyl group or an aryl group, $R_6$ represents a halogen atom such as F, Cl, Br or I, an alkyl group, an alkoxy group, an aryloxy group or an alkoxycarbonyl group, and a represents an integer of 0 to 3, with the proviso that when a is 2 or more, a plurality of $R_6$s may be the same or different.

$$(Ar—COO)_b R_7 \quad \text{(S-3)}$$

In general formula (S-3), Ar represents an aryl group, b represents an integer of 1 to 6, and $R_7$ represents a b-valent hydrocarbon group or a hydrocarbon group bonded through an ether linkage to each other.

$$(R_8—COO)_c R_9 \quad \text{(S-4)}$$

In general formula (S-4), $R_8$ represents an alkyl group or a cycloalkyl group, c represents an integer of 1 to 6, and $R_9$ represents a c-valent hydrocarbon group or a hydrocarbon group bonded through an ether linkage to each other.

$$R_{10}(COO—R_{11})_d \quad \text{(S-5)}$$

In general formula (S-5), d represents an integer of 2 to 6, $R_{10}$ represents d-valent hydrocarbon group (excluding an aromatic group), and $R_{11}$ represents an alkyl group, a cycloalkyl group or an aryl group.

Specific examples of the high boiling organic solvents used in the present invention are enumerated below:

Compounds represented by formula (S-1);

S-101
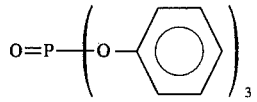
S-102
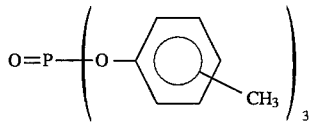
S-103
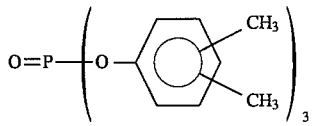
S-104
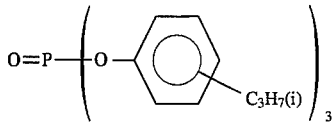
S-105
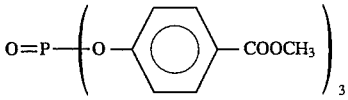
S-106
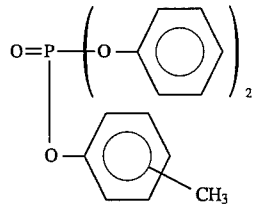
S-107
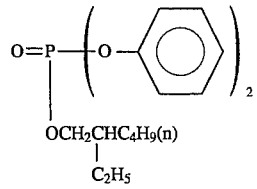
S-108 $O{=}P{-}(OC_4H_9(n))_3$
S-109 $O{=}P{-}(OC_6H_{13}(n))_3$
S-110 $O{=}P{-}(OCH_2CHC_4H_9(n))_3$ ($C_2H_5$)
S-111 $O{=}P{-}(OCH_2CHCH_2CCH_3)_3$ ($CH_3$, $CH_3$, $CH_3$, $CH_3$)
S-112 $O{=}P{-}(OC_{12}H_{25}(n))_3$
S-113 $O{=}P{-}(OC_{16}H_{33}(n))_3$
S-114 $O{=}P{-}[O(CH_2)_8CH{=}CHC_8H_{17}(n)]_3$
S-115 $O{=}P{-}(OCH_2CH_2Cl)_3$
S-116 $O{=}P{-}(OCH_2CH_2OC_4H_9(n))_3$
-continued
S-117 $O{=}P{-}(OCH_2CHCH_2Cl)_3$ (Cl)
S-118
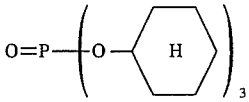
S-119
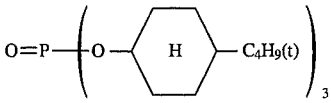
S-120
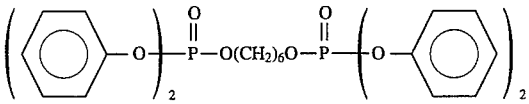
S-121
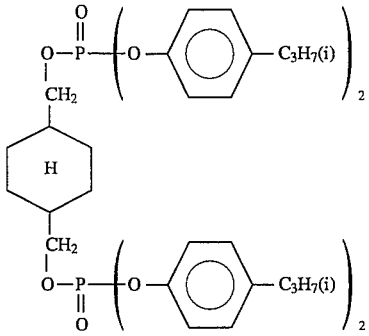
S-122 $((n)C_4H_9O)_2P{-}O(CH_2H_6O{-}P{-}(OC_4H_9(n))_2$
S-123 $O{=}P{-}(O{-}CH_2CHC_4H_9(n))_2$ ($C_2H_5$)
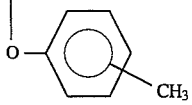
S-124
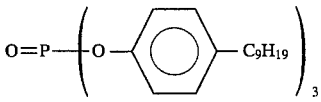
S-125 $O{=}P{-}(OC_8H_{17}(n))_2$ ($C_8H_{17}(n)$)
S-126 $O{=}P{-}(OCH_2CHC_4H_9)_2$ ($C_2H_5$)
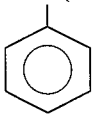
S-127 $O{=}P{-}(CH_2CHC_4H_9)_2$ ($C_2H_5$), $O{-}CH_2CHC_4H_9$ ($C_2H_5$)
S-128
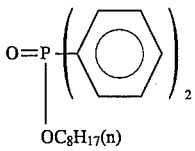

-continued
S-129
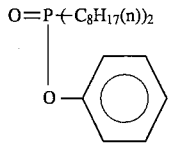
S-130
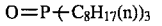
S-131
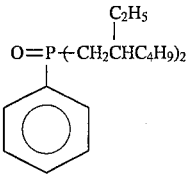
S-132
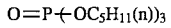
S-201
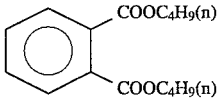
S-202
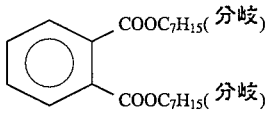
S-203
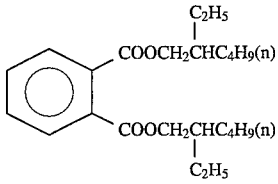
S-204
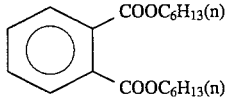
S-205
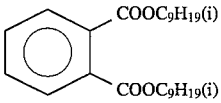
S-206
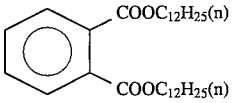
S-207
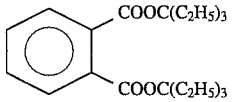
S-208
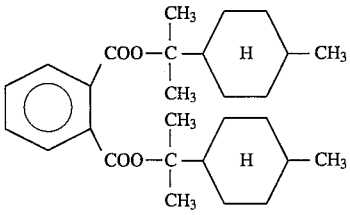
-continued
S-209
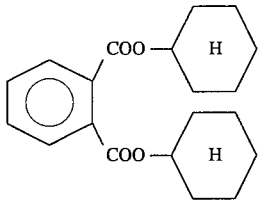
S-210
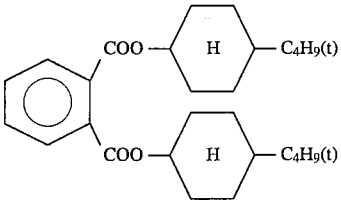
S-211
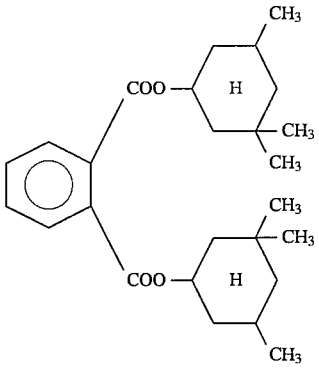
S-212
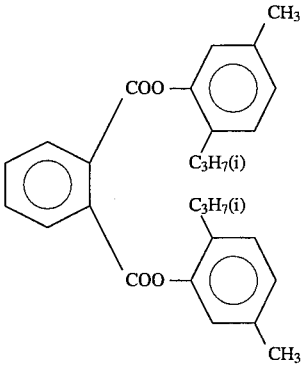
S-213
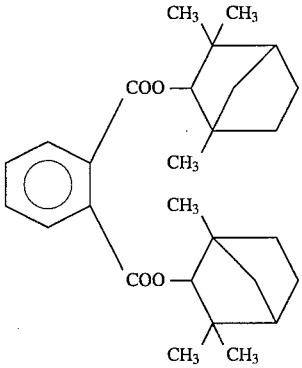
S-214
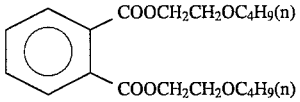

-continued

S-215

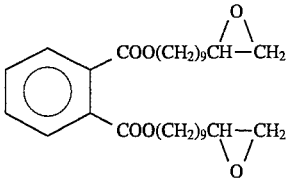

S-216

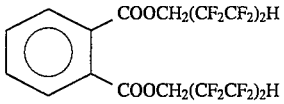

S-217

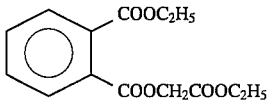

S-218

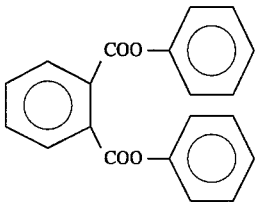

S-219

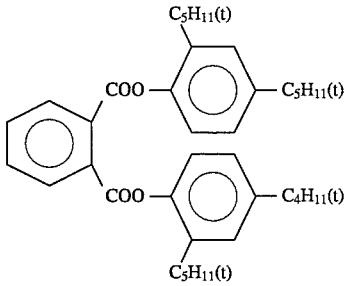

Compounds represented by formula (S-3);

S-301

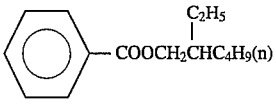

S-302

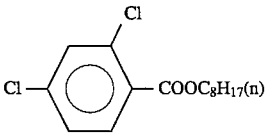

S-303

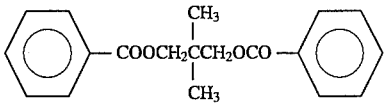

S-304

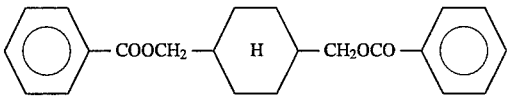

S-305

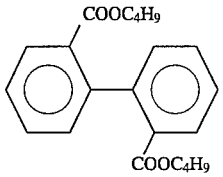

Compounds represented by formula ( S-4 );

S-401

$(n)C_{15}H_{31}COOC_{16}H_{33}(n)$

-continued

S-402

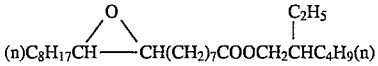

S-403

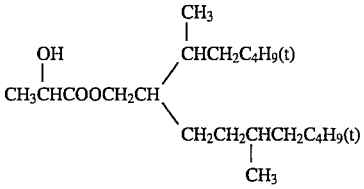

S-404

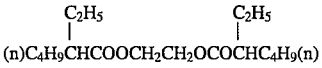

S-405

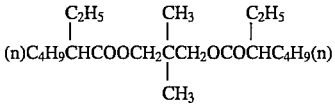

S-406

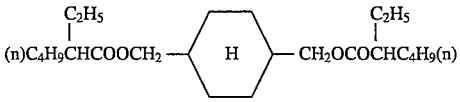

Compounds represented by formula (S-5);

S-501

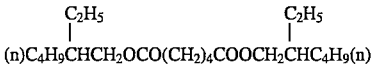

S-502

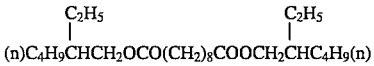

S-503

$(n)C_4H_9OCO(CH_2)_8COOC_4H_9(n)$

S-504

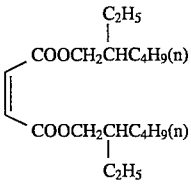

S-505

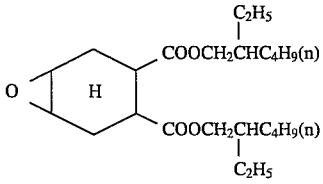

S-506

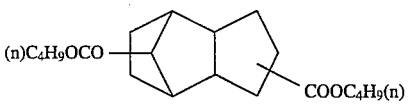

S-507

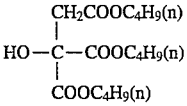

Other high boiling organic solvents which can be used according to the present invention in addition to those described above, and/or methods for producing them are described, for example, in U.S. Pat. Nos. 2,322,027, 2,533,514, 2,772,163, 2,835,579, 3,676,137, 3,912,515, 3,936,303, 4,080,209, 4,127,413, 4,193,802, 4,239,851, 4,278,757, 4,363,873, 4,483,918 and 4,745,049, European Patent 276,319A, JP-A-48-47335, JP-A-51-149028, JP-A-61-84641, JP-A-62-118345, JP-A-62-247364, JP-A-63-167357, JP-A-64-68745 and JP-A-1-101543.

The weight ratio of the high boiling organic solvents, to the yellow couplers of the present invention is 0.6 or more, preferably 0.6 to 5.0, more preferably 0.8 to 4.0, and most preferably 1.0 to 3.0.

A weight ratio of less than 0.6 causes a remarkable deterioration in light fastness, and a weight ratio exceeding 5.0 is liable to produce the problems of deterioration in film property and generation of stains formed by a lapse of time after processing. If gelatin is applied in an increased amount to avoid deterioration of the film property, the problem of prolonged drying time arises.

In order to further improve the light fastness of yellow images formed from the yellow couplers of the present invention as well as other yellow couplers, it is preferred that water-insoluble polymers are added to the silver halide emulsion layers containing the yellow couplers.

The water-insoluble polymers which can be used in the present invention include the polymers described in PCT International Publication No. WO88/00723 and JP-A-63-44658.

However, any polymers may be used in the present invention, so long as they are water-insoluble. Vinyl polymers in which repeating units have —(C=O)— linkages and polyester type polymers are preferably used.

As to vinyl monomers preferably used for synthesis of the polymers used in the present invention, two or more types of monomers are used as comonomers, corresponding to various purposes (for example, an improvement in solubility). For control of color forming property or solubility, an acid group-containing monomer may be used as the comonomer, so long as the copolymer does not become water-soluble. Further, a monomer having two or more cross-linkable ethylenic unsaturated components can be used. As such monomers, those described in JP-A-60-151636 are preferably used.

When the hydrophilic monomer (which means here a monomer providing a water-soluble homopolymer) is used as the comonomer in the vinyl monomer, there is no particular limitation on the ratio of the hydrophilic monomer to the synthesized copolymer, so long as the copolymer does not become water-soluble. However, usually the ratio will preferably be 40 mol % or less, more preferably 20 mol % or less, and most preferably 10 mol % or less. Furthermore, when the hydrophilic comonomer which is copolymerized with the monomer, has an acid group, the ratio of the comonomer having the acid group to the copolymer is usually 20 mol % or less, and preferably 10 mol % or less, from the viewpoint of image keeping quality. However, it is most preferred that such a comonomer is not used.

The monomer components contained in the polymers are preferably methacrylates, acrylamides and methacrylamides. Acrylamides and methacrylamides are most preferred.

The number average molecular weight of the polymers which can be used in the present invention is preferably 5,000 to 150,000, and more preferably 10,000 to 100,000.

The water-insoluble polymer in the present invention is a polymer having a solubility of 3 g or less, preferably 1 g or less, to 100 g of distilled water (25° C.).

Specific examples of the polymers used in the present invention are shown below, but the scope of the present invention is not limited thereto. The copolymerization ratios of the copolymers in the specific examples shown below are molar ratios.

P-1: Polymethyl methacrylate
P-2: Polyethyl methacrylate
P-3: Polyisopropyl methacrylate
P-4: Polymethyl chloroacrylate
P-5: Poly(2-tert-butylphenyl acrylate)
P-6: Poly(4-tert-butylphenyl acrylate)
P-7: Ethyl methacrylate-n-butyl acrylate copolymer (70:30)
P-8: Methyl methacrylate-a-crylonitrile copolymer (65:35)
P-9: Methyl methacrylate-styrene copolymer (90:10)
P-10: N-tert-Butylmethacrylamide-methyl methacrylate-acrylic acid copolymer (60:30:10)
P-11: Methyl methacrylate-styrene-vinylsulfonamide copolymer (70:20:10)
P-12: Methyl methacrylate-cyclohexyl methacrylate copolymer (50:50)
P-13: Methyl methacrylate-acrylic acid copolymer (95:5)
P-14: Methyl methacrylate-n-butyl methacrylate copolymer (65:35)
P-15: Methyl methacrylate-N-vinyl-2-pyrrolidone copolymer (90:10)
P-16: Poly(N-sec-butylacrylamide)
P-17: Poly(N-tert-butylacrylamide)
P-18: Cyclohexyl methacrylate-methyl methacrylate copolymer (60:40)
P-19: n-Butyl methacrylate-methyl methacrylate-acrylamide copolymer (20:70:10)
P-20: Diacetoneacrylamide-methyl methacrylate copolymer (20:80)
P-21: N-tert-Butylacrylamide-methyl methacrylate copolymer (40:60)
P-22: Poly(N-n-butylacrylamide)
P-23: tert-Butyl methacrylate-N-tert-butylacrylamide co polymer (50:50)
P-24: tert-Butyl methacrylate-methyl methacrylate co polymer (70:30)
P-25: Poly(N-tert-butylmethacrylamide)
P-26: N-tert-Butylacrylamide-methyl methacrylate copolymer (60:40)
P-27: Methyl methacrylate-acrylonitrile copolymer (70:30)
P-28: Methyl methacrylate-styrene copolymer (75:25)
P-29: Methyl methacrylate-hexyl methacrylate copolymer (70:30)
P-30: Poly(4-biphenylacrylate)
P-31: Poly(2-chlorophenyl acrylate)
P-32: Poly(4-chlorophenyl acrylate)
P-33: Poly(pentachlorophenyl acrylate)
P-34: Poly(4-ethoxycarbonylphenyl acrylate)
P-35: Poly(4-methoxycarbonylphenyl acrylate)
P-36: Poly(4-cyanophenyl acrylate)
P-37: Poly(4-methoxyphenyl acrylate)
P-38: Poly(3,5-dimethyladamantyl acrylate)
P-39: Poly(3-dimethylaminophenyl acrylate)
P-40: Poly(2-naphthyl acrylate)
P-41: Poly(phenyl acrylate)
P-42: Poly(N,N-dibutylacrylamide)
P-43: Poly(isohexylacrylamide)
P-44: Poly(isooctylacrylamide)
P-45: Poly(N-methyl-N-phenylacrylamide)
P-46: Poly(adamantyl methacrylate)
P-47: Poly(sec-butyl methacrylate)
P-48: N-tert-Butylacrylamide-acrylic acid copolymer (97:3)
P-49: Poly (2-chloroethyl methacrylate) (2-cyanoethyl methacrylate)
P-50: Poly
P-51: Poly (2-cyanomethylphenyl methacrylate)
P-52: Poly (4-cyanophenyl methacrylate)
P-53: Poly (cyclohexyl methacrylate)
P-54: Poly(2-hydroxypropyl methacrylate)

P-55: Poly(4-methoxycarbonylphenyl methacrylate)
P-56: Poly(3,5-dimethyladamantyl methacrylate)
P-57: Poly(phenyl methacrylate)
P-58: Poly(4-butoxycarbonylphenylmethacrylamide)
P-59: Poly(4-carboxyphenylmethacrylamide)
P-60: Poly(4-ethoxycarbonylphenylmethacrylamide)
P-61: Poly(4-methoxycarbonylphenylmethacrylamide)
P-62: Poly(cyclohexyl chloroacrylate)
P-63: Poly(ethyl chloroacrylate)
P-64: Poly(isobutyl chloroacrylate)
P-65: Poly(isopropyl chloroacrylate)
P-66: Poly(phenylacrylamide)
P-67: Poly(cyclohexylacrylamide)
P-68: Poly(phenylmethacrylamide)
P-69: Poly(cyclohexylmethacrylamide)
P-70: Poly(butylene adipate)

In the present invention, the amount of the water-insoluble polymer used in the silver halide color photographic material is 0.02 to 2.0, and preferably 0.2 to 2.0, by weight ratio to the yellow coupler contained in a light-sensitive layer of the photographic material. In order to improve both the light fading and the color forming properties, however, it is more preferred that the weight ratio is 0.4 to 1.5.

Methods for allowing the yellow couplers and the water-insoluble polymers of the present invention to be contained in the same layers are hereinafter described.

In the present invention, it is preferred that the coupler and the water-insoluble polymer are allowed to coexist and be finely dispersed. More preferably, the coupler and the water-insoluble polymer exist in the same drop of oil. For example, a latex of the polymer can be impregnated with the coupler of the present invention by the so-called loadable latex method (see U.S. Pat. No. 4,203,716). The methods of using organic solvent-soluble polymers described in PCT International Publication No. WO88/00723 and U.S. Pat. No. 5,006,453 can be used as more preferable methods. Namely, the polymer, the high boiling organic solvent and the coupler of the present invention are completely dissolved in an auxiliary organic solvent, and the resulting solution is dispersed in a fine particle form in water, preferably in an aqueous solution of a hydrophilic colloid, more preferably in an aqueous solution of gelatin, by means of ultrasound or a colloid mill with the aid of a dispersing agent.

The yellow couplers of the present invention are preferably used in combination with conventional antifading agents. Typical examples of such antifading agents include hydroquinones, 6-hydroxychromans, 5-hydroxycoumarans, spirochromans, spiroindanes, p-alkoxyphenols, hindered phenols such as bisphenols, gallic acid derivatives, methylenedioxybenzenes, aminophenols, hindered amines and ether or ester derivatives obtained by silylating or alkylating phenolic hydroxyl groups of these compounds.

Specific examples of the organic antifading agents are described in the following patent documents.

The hydroquinones are described in U.S. Pat. Nos. 2,360,290, 2,418,613, 2,675,314, 2,701,197, 2,728,659, 2,732,300, 2,735,765, 3,982,944, 4,430,425, 2,710,801 and 2,816,028, and British Patent 1,363,921. The 6-hydroxychromans, 5-hydroxycoumarans and spirochromans are described in U.S. Pat. Nos. 3,432,300, 3,573,050, 3,574,626, 3,698,909 and 3,764,337, and JP-A-52-152225. The spiroindanes are described in U.S. Pat. No. 4,360,589. The p-alkoxyphenols are described in U.S. Pat. No. 2,735,765, British Patent 2,066,975, JP-A-59-10539 and JP-B-57-19765 (the term "JP-B" as used therein means an "examined Japanese patent publication").

The hindered phenols are described in U.S. Pat. Nos. 3,700,455 and 4,228,235, JP-A-52-72225 and JP-B-52-6623. The gallic acid derivatives, the methylenedioxybenzenes and the aminophenols are each described in U.S. Pat. Nos. 3,457,079 and 4,332,886 and JP-B-56-21144. The hindered amines are described in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344.

Of the above-described antifading agents, preferred are the hindered phenols represented by the following general formula (IV) and the bisphenols represented by the following general formula (V).

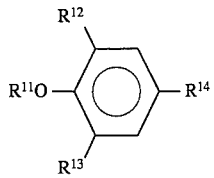

(IV)

In general formula (IV), $R^{11}$ represents a hydrogen atom, an alkyl group, an alkenyl group, an aryl group, an allyl group, an acyl group or a silyl group; and $R^{12}$ and $R^{13}$ are straight or branched alkyl groups of 3 to 8 carbon atoms, which are bonded preferably through secondary or tertiary carbon, more preferably through tertiary carbon. Specific examples of such alkyl groups include n-butyl, iso-propyl, tert-butyl and tert-amyl. Further, the alkyl groups may have appropriate substituents at any positions of the alkyl chains. $R^{14}$ may be any group, as long as it is a monovalent organic group. Furthermore, $R^{14}$ may contain a hindered phenol or bisphenol moiety.

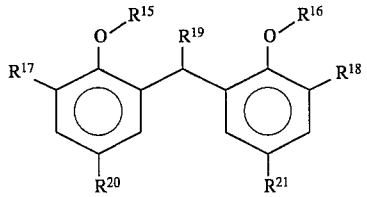

(V)

In general formula (V), $R^{15}$ and $R^{16}$ each independently represents a hydrogen atom, an alkyl group, an alkenyl group, an aryl group, an allyl group, an acyl group, a phosphonyl group, a phosphinyl group or a sulfonyl group, and $R^{15}$ and $R^{16}$ may combine through the above-described group to form a ring $R^{17}$, $R^{18}$, $R^{20}$ and $R^{21}$ represent straight or branched alkyl groups of 1 to 8 carbon atoms. Specific examples include methyl, ethyl, n-propyl, iso-propyl, tert-butyl, tert-amyl, cyclohexyl, 1-methyl. Cyclohexyl and cyclopentyl. The above-described alkyl groups may have appropriate substituents including halogen atoms. $R^{19}$ is a hydrogen atom or a straight or branched alkyl group of 1 to 8 carbon atoms. Specific examples thereof include methyl, ethyl, n-propyl, isopropyl, n-butyl, sec-butyl, iso-butyl, tert-butyl, tertamyl and cyclohexyl.

Specific examples of the hindered phenols and bisphenols preferably used in the present invention include, but are not limited to, the following compounds:

HP-1

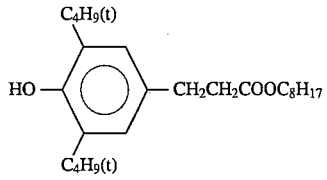

-continued
HP-2
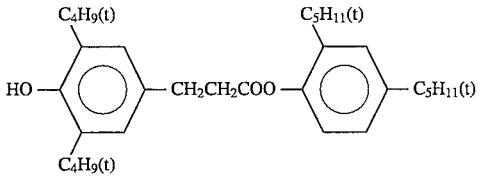
HP-3
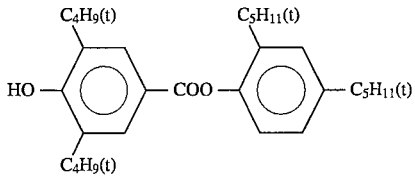
HP-4
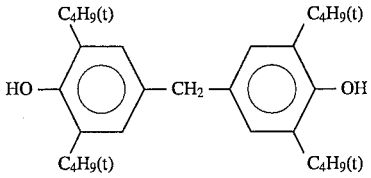
HP-5
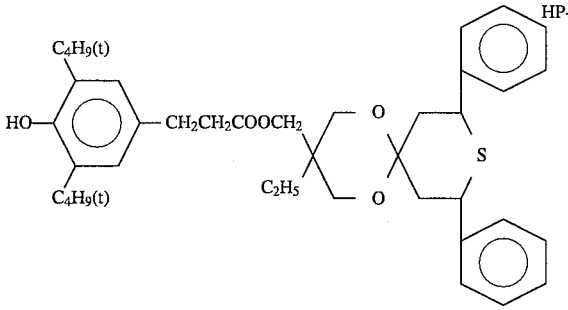
HP-6
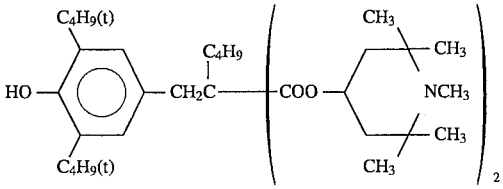
HP-7
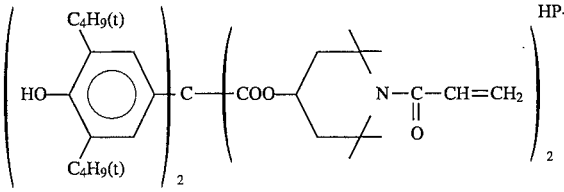
HP-8
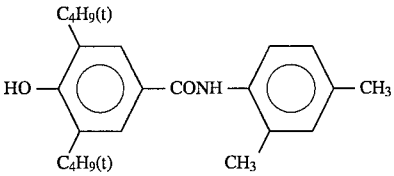
HP-9
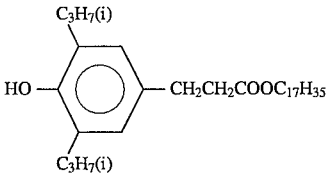
-continued
HP-10
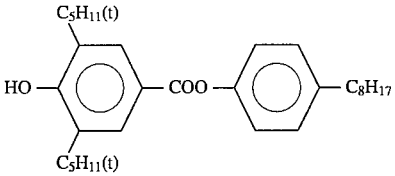
HP-11
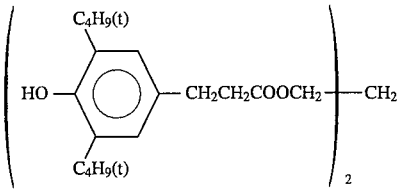
HP-12
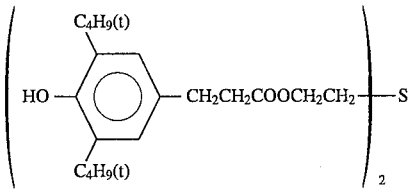
HP-13
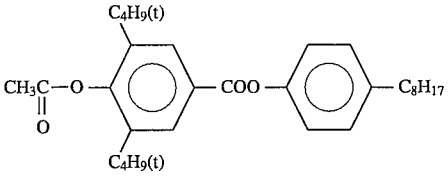
HP-14
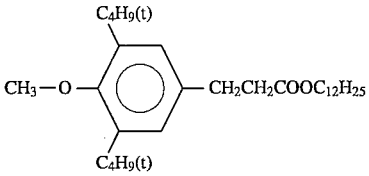
BP-1
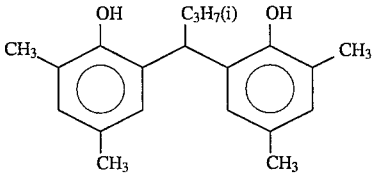
BP-2
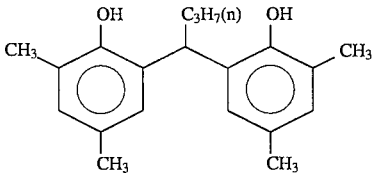
BP-3
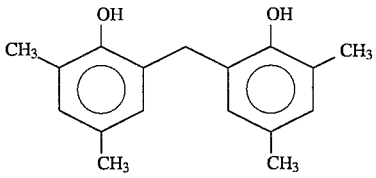
BP-4
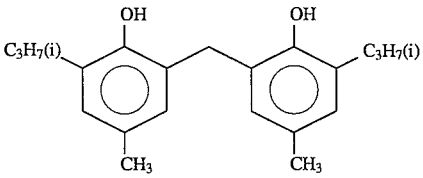

-continued

BP-5

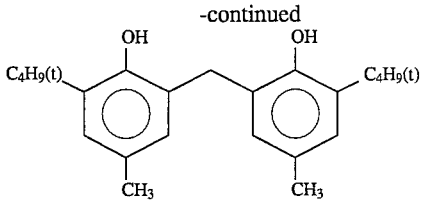

BP-6

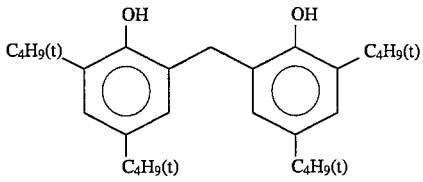

BP-7

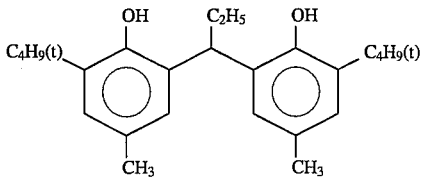

BP-8

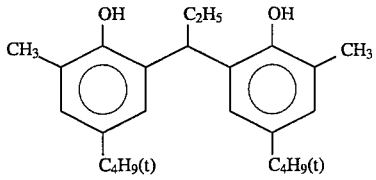

BP-14

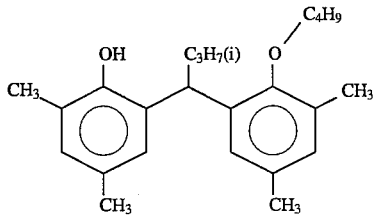

BP-15

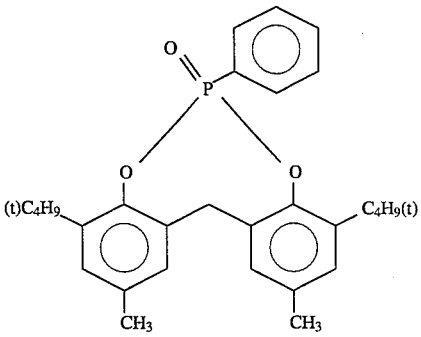

BP-16

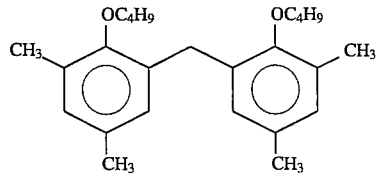

-continued

BP-17

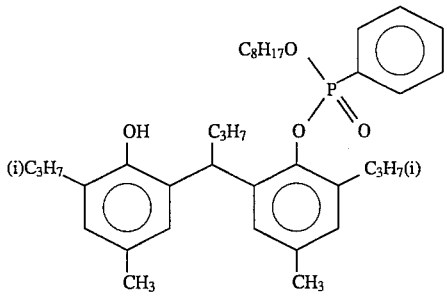

The silver halides used in the silver halide photographic materials of the present invention include silver chloride, silver chloroiodide, silver chloro(iodo)bromide, silver bromide and silver iodobromide. In particular, silver chlorobromide or silver chloride substantially free from silver iodide and containing 90 mol % or more (more preferably 98 mol % or more) of silver chloride is preferably used for rapid processing.

In the photographic materials according to the present invention, it is preferred that the dyes decolorizable by processing (oxonol dyes among others) described in European Patent 0,337,490A2, pages 27 to 76 are added to hydrophilic colloidal layers so that the optical reflection density of the photographic materials at 680 nm reaches 0.70 or more, or that 12% by weight or more (more preferably 14% by weight or more) of titanium oxide surface-treated with dihydric to tetrahydric alcohols (for example, trimethylolethane) is added to water-resistant resin layers of supports, for an improvement in sharpness of images.

In the photographic materials of the present invention, compounds for improving the keeping quality of color images described in European Patent 0,277,589A2 are preferably used in combination with the couplers. In particular, they are preferably used in combination with pyrazoloazole couplers or pyrrolotriazole couplers.

Namely, in order to prevent the production of stains caused by the formation of a forming dye due to reaction of a color developing agent remaining in a film or an oxidation product thereof with a coupler during storage after processing, and other side effects, it is preferred to use a compound (F) which is chemically bonded to an aromatic amine developing agent remaining after color development to form a chemically inactive, substantially colorless compound, and/or a compound (G) which is chemically bonded to an oxidation product of an aromatic amine color developing agent remaining after color development to form a chemically inactive, substantially colorless compound.

Further, it is preferred that antifungal agents such as those described in JP-A-63-271247, be added to the photographic materials of the present invention to prevent various molds and bacteria from breeding in the hydrophilic colloidal layers and deteriorating images.

A white-polyester support or a support provided with a white pigment-containing layer on the side coated with silver halide emulsion layers, may be used as supports for the photographic material of the present invention. Furthermore, in order to improve sharpness, an antihalation layer is preferably formed on the side coated with silver halide emulsion layers, or on the back surface, of the support. In particular, it is preferred that the transmission density be established within the range of 0.35 to 0.8 so that the display can be appreciated with both reflected light and transmitted light.

The photographic materials of the present invention may be exposed to visible light or infrared light. Exposing methods may be either low illuminance exposure or high illumination exposure for a short time. In particular, in the latter case, a laser scanning exposing method in which the exposing time is shorter than $10^{-4}$ second is preferred.

In exposing, the band stop filter described in U.S. Pat. No. 4,880,726 is preferably used, whereby optical color mixing is eliminated and color reproducibility is markedly improved.

It is preferred that the color photographic materials of the present invention be subjected to color development, bleach-fixing and washing (or stabilizing), after exposure. The bleaching and fixing may be carried out separately, not using the single bath process as described above.

Silver halide emulsions, other materials such as additives and photographic constituent layers such as layer arrangements applied to the photographic materials of the present invention, and processing methods and additives for processing applied to treat the photographic materials, which are preferably used, are described in the following patents shown in Table 1, particularly in European Patent 0,355,660A2 (JP-A-2-139544).

TABLE 1

| Photographic Constituents, etc. | JP-A-62-215272 | JP-A-2-33144 | EP0,355,660A2 |
|---|---|---|---|
| Silver Halide Emulsions | Page 10, upper right column, line 6 to page 12, lower left column, line 5; page 12, lower right column, line 4 from the bottom to page 13, upper left column, line 17 | Page 28, upper right column, line 16 to page 29, lower right column, line 11; page 30, line 2 to line 5 | Page 45, line 53 to page 47, line 3; page 47, line 20 to line 22 |
| Solvents for Silver Halides | Page 12, lower left column, line 6 to line 14; page 13, upper left column, line 3 from the bottom to page 18, lower left column, the last line | — | — |
| Chemical Sensitizers | Page 12, lower left column, line 3 from the bottom to lower right column, line 5 from the bottom; page 18, lower right column, line 1, to page 22, upper right column, line 9 from the bottom | Page 29, lower right column, line 12 to the last line | Page 47, line 4 to line 9 |
| Spectral Sensitizers (Spectrally Sensitizing Methods) | Page 22, upper right column, line 8 from the bottom to page 38, the last line | Page 30, upper left column, line 1 to line 13 | Page 47, line 10 to line 15 |
| Emulsion Stabilizers | Page 39, upper left column, line 1 to page 72, upper right column, the last line | Page 30, upper left column, line 14 to upper right column, line 1 | Page 47, line 16 to line 19 |
| Development Accelerators | Page 72, lower left column, line 1 to page 91, upper right column, line 3 | — | — |
| Color Couplers (Cyan, Magenta, Yellow Couplers) | Page 91, upper right column, line 4 to page 121, upper left column, line 6 | Page 3, upper right column, line 14 to page 18, upper left column, the last line; page 30, upper right column, line 6 to page 35, lower right column, line 11 | Page 4, line 15 to line 27; page 5, line 30 to page 28, the last line; page 45, line 29 to line 31; page 47, line 23 to page 63, line 50 |
| Color Development Increasing Agents | Page 121, upper left column, line 7 to page 125, upper right column, line 1 | — | — |
| Ultraviolet Absorbers | Page 125, upper right column, line 2 to page 127, lower left column, the last line | Page 37, lower right column, line 14 to page 38, upper left column, line 11 | Page 65, line 22 to line 31 |
| Antifading Agents (Image Stabilizers) | Page 127, lower right column, line 1 to page 137, lower left column, line 8 | Page 36, upper right column, line 12 to page 37, upper left column, line 19 | Page 4, line 30 to page 5, line 23; page 29, line 1 to page 45, line 25; page 45, line 33 to line 40; page 65, line 2 to line 21. |
| High Boiling and/or Low Boiling Organic Solvents | Page 137, lower left column, line 9 to page 144, upper right column, the last line | Page 35, lower right column, line 14 to page 36, upper left column, line 4 from the bottom | Page 64, line 1 to line 51 |
| Dispersing Methods of Photographic Additives | Page 144, lower left column, line 1 to page 146, upper right column, line 7 | Page 27, lower right column, line 10 to page 28, upper left column, the last line; page 35, lower right column, line 12 to page 36, upper right column, line 7 | Page 63, line 51 to page 64, line 56 |
| Hardeners | Page 146, upper right column, line 8 to page 155, lower left column, line 4 | — | — |
| Developing Agent Precursors | Page 155, lower left column, line 5 to lower right column, | — | — |

TABLE 1-continued

| Photographic Constituents, etc. | JP-A-62-215272 | JP-A-2-33144 | EP0,355,660A2 |
|---|---|---|---|
| | line 2 | | |
| Development Restrainer-Releasing Compounds | Page 155, lower right column, line 3 to line 9 | — | — |
| Supports | Page 155, lower right column, line 19 to page 156, upper left column, line 14 | Page 38, upper right column, line 18 to page 39, upper left column, line 3 | Page 66, line 29 to page 67, line 13 |
| Photographic Material Layer Constitution | Page 156, upper left column, line 15 to page 156, lower right column, line 14 | Page 28, upper right column, line 1 to line 15 | Page 45, line 41 to line 52 |
| Dyes | Page 156, lower right column, line 15 to page 184, lower right column, the last line | Page 38, upper left column, line 12 to upper right column, line 7 | Page 66, line 18 to line 22 |
| Color Mixing Inhibitors | Page 185, upper left column, line 1 to page 188, lower right column, line 3 | Page 36, upper right column, line 8 to line 11 | Page 64, line 57 to page 65, line 1 |
| Gradation Modifiers | Page 188, lower right column, line 4 to line 8 | — | — |
| Stain Inhibitors | Page 188, lower right column, line 9 to page 193, lower right column, line 10 | Page 37, upper left column, the last line to lower right column, line 13 | Page 65, line 32 to page 66, line 17 |
| Surfactants | Page 201, lower left column, line 1 to page 210, upper right column, the last line | Page 18, upper right column, line 1 to page 24, lower right column, the last line; page 27, lower left column, line 10 from the bottom to lower right column, line 9 | — |
| Fluorine-Containing Compounds (Antistatic Agents, Coating Aids, Lubricants, Adhesion Inhibitors) | Page 210, lower right column, line 1 to page 222, lower left column, line 5 | Page 25, upper left column, line 1 to page 27, lower right column, line 9 | — |
| Binders (Hydrophilic Colloids) | Page 222, lower left column, line 6 to page 225, upper left column, the last line | Page 38, upper right column, line 8 to line 18 | Page 66, line 23 to line 28 |
| Tackifiers | Page 225, upper right column, line 1 to page 227, upper right column, line 2 | — | — |
| Antistatic Agents | Page 227, upper right column, line 3 to page 230, upper left column, line 1 | — | — |
| Polymer Latices | Page 230, upper left column, line 2 to page 239, the last line | — | — |
| Matting Agents | Page 240, upper left column, line 1 to upper right column, the last line | — | — |

Note:
The cited portions of JP-A-62-215272 include the contents of the amendment dated March, 16, 1987 which is given in the end of the publication. In addition, of the above-described color couplers, as yellow couplers, so-called short wave type yellow couplers are also preferably used, and are described in JP-A-63-231451, JP-A-63-123047, JP-A-63-241547, JP-A-1-173499, JP-A-1-213648 and JP-A-1-250944.

Cyan couplers preferably used include the diphenylimidazole cyan couplers described in JP-A-2-33144, the 3-hydroxypyridine cyan couplers described in European Patent 0,333,185A2 including the coupler made 2-equivalent by giving a chlorine eliminatable group to a 4-equivalent coupler of coupler (42), and couplers (6) and (9), which are particularly preferred, and the cyclic active methylene cyan couplers described in JP-A-64-32260 including couplers (3), (8) and (34) which are particularly preferred.

As a method for processing the silver halide color photographic materials using the high silver chloride emulsions containing at least 90 mol % of silver chloride, the method described on page 27, upper left column, to page 34, upper right column, of JP-A-2-207250 is preferably applied.

The present invention will be further illustrated in greater detail with reference to the following examples, which are, however, not to be construed as limiting the invention.

The structures of high boiling organic solvents used in the following examples, other than those compounds represented by general formulae (S-1) to (S-5), are as follows:

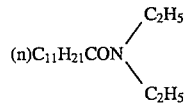

S-601

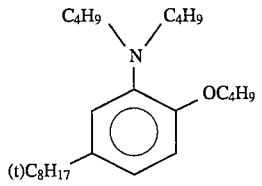

S-602

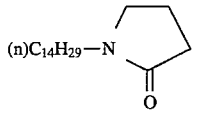

S-603

EXAMPLE 1

Using a triacetyl cellulose support having an under coat, monolayer photographic material 101 for evaluation having the following layer constitution, was prepared.

Preparation of Emulsion Layer Coating Solution

To 1.85 mmol of a coupler, 10 cc of ethyl acetate and 40% by weight (to the coupler) of trioctyl phosphate (a high boiling organic solvent, hereinafter also referred to as "an oil"), were added to dissolve the coupler. The resulting solution was dispersed by emulsification in 33 g of a 14% aqueous solution of gelatin containing 3 cc of a 10% solution of sodium dodecylbenzenesulfonate. On the other hand, a silver chlorobromide emulsion (silver bromide: 70 mol %) was sulfur sensitized and mixed -with the above-described emulsified product to prepare a coating solution so as to give the following composition. As a hardener, sodium salt of 1-oxy-3,5-dichloro-s-triazine was used.

Layer Constitution

The layer constitution of the sample used in this experiment is shown below. Numerals indicate coated weights ($g/m^2$).

| | |
|---|---|
| Support | |
| Triacetyl Cellulose Support | |
| Emulsion Layer | |
| Silver Chlorobromide (described above) | 4.0 mmol |
| Coupler (see Table 2) | 1.0 mmol |
| Solvent (see Table 2) | (40% by weight of coupler) |
| Gelatin | 5.2 g |
| Protective Layer | |
| Gelatin | 1.3 g |
| Acrylic Modified Copolymer of Polyvinyl Alcohol (degree of modification: 17%) | 0.17 g |
| Liquid Paraffin | 0.03 g |

The above-described photographic material was subjected to imagewise exposure using an optical wedge, and thereafter processed according to the following processing stages.

Processing Stages

| Processing Stage | Temperature (°C.) | Time (min) |
|---|---|---|
| Color Development | 33 | 2 |
| Bleach-Fixing | 33 | 1.5 |
| Washing | 33 | 3 |

-continued

| | |
|---|---|
| Composition of Processing Solutions | |
| Color Developing Solution | |
| Distilled Water | 800 ml |
| Triethanolamine | 8.1 g |
| Diethylhydroxylamine | 4.2 g |
| Potassium Bromide | 0.6 g |
| Sodium Hydrogencarbonate | 3.9 g |
| Sodium Sulfite | 0.13 g |
| N-Ethyl-N-(β-methanesulfonamidoethyl)-3-methyl-4-aminoaniline Sulfate | 5.0 g |
| Potassium Carbonate | 18.7 g |
| Water to make | 1000 ml |
| pH | 10.25 |
| Bleach-Fixing Solution | |
| Distilled Water | 400 ml |
| Ammonium Thiosulfate (700 g/liter) | 150 ml |
| Sodium Sulfate | 18.0 g |
| Ethylenediaminetetraacetic Acid (III) Ammonium | 55.0 g |
| Sodium Ethylenediaminetetraacetate | 5.0 g |
| Water to make | 1000 ml |
| pH | 6.7 |

Then, samples 102 to 165 were prepared in the same manner as with sample 101 with the exception that couplers were changed so as to become equimolar to sample 101, and the kinds and the amounts of oils used (the weight ratios of the oils to the couplers) were changed as shown in Table 2. These samples were exposed, followed by processing, in the same manner as the above-described sample 101.

For the processed samples, the yellow color forming density was measured through a blue color filter to prepare sensitometry curves. The maximum color forming density (Dmax) was read from these curves. The Dmax value mainly depends on the molecular extinction coefficient and coupling activity of the yellow coupler. Accordingly, a coupler showing an increase in this value can be said to be an excellent coupler high in color forming property.

Then, in order to evaluate the color image fastness of the above-described samples against light, the samples were irradiated with Xe light of 100,000 luxes (by an intermittent irradiation process of 3-hour irradiation/1-hour putting out lights) for 14 days, and then the density was measured again. The density of residual color images at Dmax portions was determined by percentage as evaluated values, which are shown in Table 2.

TABLE 2

| | | Oil | | Color Forming Property | Fading Xe,14 days | |
|---|---|---|---|---|---|---|
| Sample | Coupler | Kind | Amount | (Dmax) | (residual rate) | Remark |
| 101 | ExY-1 | S-110 | 0.4 | 1.28 | 74 | Comparison |
| 102 | ExY-1 | S-110 | 0.6 | 1.43 | 67 | Comparison |
| 103 | ExY-1 | S-110 | 1.0 | 1.51 | 53 | Comparison |
| 104 | ExY-1 | S-102 | 0.4 | 1.27 | 83 | Comparison |
| 105 | ExY-1 | S-102 | 0.6 | 1.48 | 79 | Comparison |
| 106 | ExY-1 | S-102 | 1.0 | 1.52 | 74 | Comparison |
| 107 | ExY-1 | S-201 | 0.4 | 1.46 | 80 | Comparison |
| 108 | ExY-1 | S-201 | 0.6 | 1.51 | 73 | Comparison |
| 109 | ExY-1 | S-201 | 1.0 | 1.53 | 62 | Comparison |
| 110 | ExY-1 | S-502 | 0.4 | 1.35 | 75 | Comparison |
| 111 | ExY-1 | S-502 | 0.6 | 1.42 | 69 | Comparison |
| 112 | ExY-1 | S-502 | 1.0 | 1.50 | 56 | Comparison |
| 113 | (2) | S-110 | 0.4 | 1.94 | 41 | Comparison |
| 114 | (2) | S-110 | 0.6 | 1.97 | 75 | Invention |

TABLE 2-continued

| Sample | Coupler | Oil Kind | Oil Amount | Color Forming Property (Dmax) | Fading Xe,14 days (residual rate) | Remark |
|---|---|---|---|---|---|---|
| 115 | (2) | S-110 | 0.8 | 1.99 | 82 | Invention |
| 116 | (2) | S-110 | 1.0 | 2.00 | 87 | Invention |
| 117 | (2) | S-110 | 2.0 | 2.01 | 91 | Invention |
| 118 | (2) | S-102 | 0.4 | 1.93 | 35 | Comparison |
| 119 | (2) | S-102 | 0.6 | 1.97 | 71 | Invention |
| 120 | (2) | S-102 | 0.8 | 2.02 | 78 | Invention |
| 121 | (2) | S-102 | 1.0 | 2.04 | 83 | Invention |
| 122 | (2) | S-102 | 2.0 | 2.03 | 86 | Invention |
| 123 | (2) | S-201 | 0.4 | 1.97 | 32 | Comparison |
| 124 | (2) | S-201 | 0.6 | 2.02 | 67 | Invention |
| 125 | (2) | S-201 | 0.8 | 2.04 | 74 | Invention |
| 126 | (2) | S-201 | 1.0 | 2.04 | 79 | Invention |
| 127 | (2) | S-201 | 2.0 | 2.03 | 83 | Invention |
| 128 | (2) | S-502 | 0.4 | 1.96 | 34 | Comparison |
| 129 | (2) | S-502 | 0.6 | 1.98 | 69 | Invention |
| 130 | (2) | S-502 | 0.8 | 1.99 | 75 | Invention |
| 131 | (2) | S-502 | 1.0 | 2.00 | 81 | Invention |
| 132 | (2) | S-502 | 2.0 | 2.00 | 85 | Invention |
| 133 | (2) | S-407 | 0.4 | 1.92 | 35 | Comparison |
| 134 | (2) | S-407 | 0.6 | 1.95 | 70 | Invention |
| 135 | (2) | S-407 | 1.0 | 1.96 | 76 | Invention |
| 136 | (2) | S-301 | 0.4 | 1.94 | 32 | Comparison |
| 137 | (2) | S-301 | 0.6 | 1.98 | 68 | Invention |
| 138 | (2) | S-301 | 1.0 | 1.99 | 75 | Invention |
| 139 | (1) | S-111 | 0.4 | 2.08 | 37 | Comparison |
| 140 | (1) | S-111 | 0.6 | 2.09 | 72 | Invention |
| 141 | (1) | S-111 | 1.0 | 2.10 | 84 | Invention |
| 142 | (1) | S-104 | 0.4 | 2.12 | 32 | Comparison |
| 143 | (1) | S-104 | 0.6 | 2.13 | 69 | Invention |
| 144 | (1) | S-104 | 1.0 | 2.13 | 76 | Invention |
| 145 | (1) | S-205 | 0.4 | 2.14 | 30 | Comparison |
| 146 | (1) | S-205 | 0.6 | 2.14 | 66 | Invention |
| 147 | (1) | S-205 | 1.0 | 2.14 | 73 | Invention |
| 148 | (29) | S-111 | 0.4 | 2.16 | 46 | Comparison |
| 149 | (29) | S-111 | 1.0 | 2.18 | 90 | Invention |
| 150 | (16) | S-111 | 0.4 | 2.04 | 43 | Comparison |
| 151 | (16) | S-111 | 1.0 | 2.07 | 88 | Invention |
| 152 | (25) | S-111 | 0.4 | 1.93 | 45 | Comparison |
| 153 | (25) | S-111 | 1.0 | 1.95 | 89 | Invention |
| 154 | (8) | S-111 | 0.4 | 2.04 | 48 | Comparison |
| 155 | (8) | S-111 | 1.0 | 2.06 | 91 | Invention |
| 156 | (37) | S-111 | 0.4 | 1.96 | 28 | Comparison |
| 157 | (37) | S-111 | 1.0 | 2.02 | 70 | Invention |
| 158 | (2) | S-601 | 0.4 | 1.84 | 43 | Comparison |
| 159 | (2) | S-601 | 1.0 | 1.87 | 73 | Invention |
| 160 | (2) | S-602 | 0.4 | 1.88 | 18 | Comparison |
| 161 | (2) | S-602 | 1.0 | 1.90 | 57 | Invention |
| 162 | (2) | S-125 | 0.4 | 1.98 | 35 | Comparison |
| 163 | (2) | S-125 | 1.0 | 2.04 | 80 | Invention |
| 164 | (2) | S-130 | 0.4 | 2.01 | 39 | Comparison |
| 165 | (2) | S-130 | 1.0 | 2.05 | 78 | Invention |

ExY-1

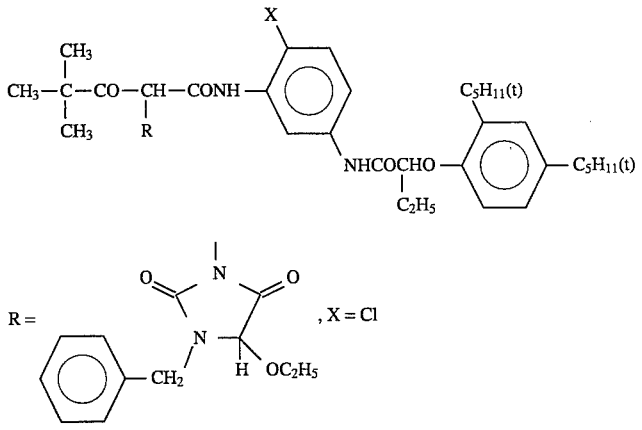

The results shown in Table 2 reveal that coupler Ex-Y for comparison has a tendency to be improved in color forming property as the amounts of the high boiling organic solvents used increase, but the light fastness decreases. Thus, the conventional acylacet-anilide-type couplers including the pivaloyl-type yellow couplers tend to be improved in light fastness with decreases in the amounts used of the high boiling organic solvents.

In contrast, the results shown in Table 2 reveal that the couplers of the present invention exhibit color forming density as high as 1.4 to 1.5 times that of ExY-1, regardless of the amounts of the high boiling organic solvents used.

Further, the color image fastness against light is significantly improved when the amounts of the high boiling organic solvents used (the weight ratios of the solvents to the couplers) are 0.6 or more. This fact can not be anticipated at all from the light fading behavior of the acylacetanilide-type yellow couplers described above.

As is described above, when the high boiling organic solvents are used in weight ratios to the couplers of 0.6 or more with the yellow couplers of the present invention, it becomes possible to realize the high color forming property and the excellent light fastness at the same time.

EXAMPLE 2

Using a triacetyl cellulose support having an under coat, monolayer photographic material 201 was prepared for evaluation having the following layer constitution.

Preparation of Emulsion Layer Coating Solution

To 1.85 mmol of a coupler, 10 cc of ethyl acetate, and 40% by weight (to the coupler) of tricresyl phosphate (a high boiling organic solvent), were added to dissolve the coupler. The resulting solution was dispersed by emulsification in 33 g of a 14% aqueous solution of gelatin containing 3 cc of a 10% solution of sodium dodecylbenzene-sulfonate. On the other hand, a silver chlorobromide emulsion was prepared; cubic, a 3:7 mixture (silver molar ratio) of a large-sized emulsion having a mean grain size of 0.88 μm and a small-sized emulsion having a mean grain size of 0.70 μm, coefficients of variation in grain size distribution for the respective emulsions being 0.08 and 0.10, each emulsion comprising silver halide grains in which 0.3 mol % of silver bromide is localized on part of the surface of each grain and the remainder is silver chloride. Each of blue sensitizing dyes A and B shown below was added to this emulsion in an amount of $2.0\times10^{-4}$ mol per mol of silver for the large-sized emulsion, and in an amount of $2.5\times10^{-4}$ mol per mol of silver for the small-sized emulsion. Chemical sensitization of this emulsion was carried out by adding a sulfur sensitizing agent and a gold sensitizing agent. This emulsion and the abovedescribed emulsified product were mixed with each other to prepare a coating solution so as to give the following composition. As a hardener, sodium salt of 1-oxy-3,5-dichloro-s-triazine was used.

Layer Constitution

The layer constitution of the sample used in this experiment is shown below. Numerals indicate coated weights ($g/m^2$).

| | |
|---|---|
| Support | |
| Triacetyl Cellulose Support | |
| Emulsion Layer | |
| Silver Chlorobromide (described above) | 3.0 mmol |
| Coupler (see Table 3) | 1.0 mmol |
| Solvent (see Table 3) | (40% by weight of coupler) |
| Gelatin | 5.5 g |
| Protective Layer | |
| Gelatin | 1.5 g |
| Acrylic Modified Copolymer of Polyvinyl Alcohol (degree of modification: 17%) | 0.15 g |
| Liquid Paraffin | 0.03 g |
| Blue-Sensitive Emulsion Layer | |

Sensitizing Dye A

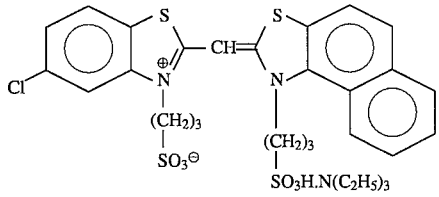

and
Sensitizing Dye B

-continued

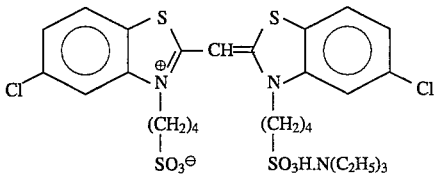

ExY-2

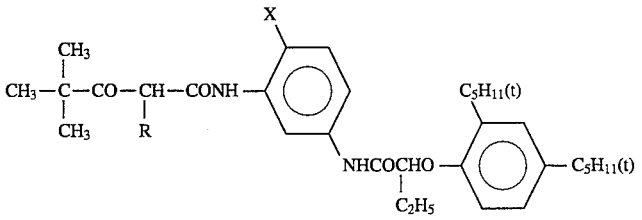

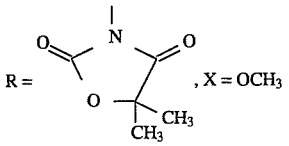

The above-described photographic material was subjected to exposure through an optical wedge, and thereafter processed according to the following stages.

Processing Stages

| Processing Stage | Temperature (°C.) | Time (sec) |
|---|---|---|
| Color Development | 35 | 45 |
| Bleaching-Fixing | 35 | 45 |
| Stabilizing (1) | 35 | 20 |
| Stabilizing (2) | 35 | 20 |
| Stabilizing (3) | 35 | 20 |
| Stabilizing (4) | 35 | 20 |
| Drying | 80 | 60 |

Four-tank countercurrent system from stabilizing (4) to stabilizing (1) was employed.

The composition of each processing solution was as follows:

Color Developing Solution

| | |
|---|---|
| Water | 800 ml |
| 1-Hydroxyethylidene-1,1-diphosphonic Acid (60%) | 0.8 ml |
| Triethanolamine | 8.0 g |
| Sodium Chloride | 1.4 g |
| Potassium Bromide | 0.03 g |
| N,N-Diethylhydroxylamine | 4.6 g |
| Potassium Carbonate | 27 g |
| Sodium Sulfite | 0.1 g |
| N-Ethyl-N-(β-methanesulfonamidoethyl)-3-methyl-4-aminoaniline 3/2 Sulfate Monohydrate | 4.5 g |
| Lithium Sulfate (anhydrous) | 2.7 g |
| Fluorescent Brightener (4,4'-diaminostilbene type) | 2.0 g |
| Water to make | 1000 ml |
| pH (by adding potassium hydroxide) | 10.25 |

Bleach-Fixing Solution

| | |
|---|---|
| Water | 400 ml |

-continued

| | |
|---|---|
| Ammonium Thiosulfate (700 g/liter) | 100 ml |
| Sodium Sulfite | 18 g |
| Ethylenediaminetetraacetic Acid Fe(III) Ammonium | 55 g |
| Disodium Ethylenediaminetetraacetate | 3 g |
| Glacial Acetic Acid | 9 g |
| Water to make | 1000 ml |
| pH | 5.4 |

Stabilizing Solution

| | |
|---|---|
| Benzoisothiazoline-3-one | 0.02 g |
| Polyvinylpyrrolidone | 0.05 g |
| Water to make | 1000 ml |
| pH | 7.0 |

Then, samples 202 to 269 were prepared in the same manner as sample 201, with the exception that the types of couplers, and the types and amounts of high boiling organic solvents (the weight ratios of the solvents to the couplers) were changed as shown in Table 3. When the couplers of the present invention were used, the total amounts applied were reduced to 70% by weight of that of sample 201. These samples were also exposed, followed by processing, in the same manner as with the above-described sample 201.

For the processed samples, the yellow color forming density and the magenta component density in yellow were measured through a blue color filter and a green color filter, respectively, to prepare respective sensitometry curves. The magenta component at a yellow color forming density of 1.5, which is determined by the following equation from these curves, was taken as a measure for indicating hue, $D_G/D_B$.

Magenta Component=100×Magenta Density/Yellow Color Forming Density

The magenta component on yellow color forming is decreased, as this value is lowered. A lowered value shows that hue is excellent.

The color image fastness against light was evaluated the same manner as with Example 1, with the proviso that the residual rate was indicated by a value at an initial density of 1.5.

TABLE 3

| Sample | Coupler | High Boiling Organic Solvent Kind | Dielectric Const. | Amount | Hue (DG/DB) (%) | Fading (residual rate) (%) | Remark |
|---|---|---|---|---|---|---|---|
| 201 | ExY-1 | S-102 | 7.33 | 0.4 | 7.2 | 70 | Comparison |
| 202 | ExY-1 | S-102 | 7.33 | 1.0 | 7.0 | 59 | Comparison |
| 203 | ExY-1 | S-124 | 5.08 | 0.4 | 6.9 | 65 | Comparison |
| 204 | ExY-1 | S-124 | 5.08 | 1.0 | 6.7 | 48 | Comparison |
| 205 | ExY-1 | S-110 | 4.80 | 0.4 | 6.7 | 58 | Comparison |
| 206 | ExY-1 | S-110 | 4.80 | 1.0 | 6.3 | 42 | Comparison |
| 207 | ExY-1 | S-111 | 4.46 | 0.4 | 6.7 | 69 | Comparison |
| 208 | ExY-1 | S-111 | 4.46 | 1.0 | 6.4 | 60 | Comparison |
| 209 | ExY-1 | S-201 | 6.45 | 0.4 | 7.0 | 62 | Comparison |
| 210 | ExY-1 | S-201 | 6.45 | 1.0 | 6.8 | 45 | Comparison |
| 211 | ExY-1 | S-203 | 5.18 | 0.4 | 6.9 | 65 | Comparison |
| 212 | ExY-1 | S-203 | 5.18 | 1.0 | 6.6 | 61 | Comparison |
| 213 | ExY-2 | S-102 | 7.33 | 0.4 | 5.1 | 55 | Comparison |
| 214 | ExY-2 | S-102 | 7.33 | 1.0 | 4.8 | 40 | Comparison |
| 215 | ExY-2 | S-110 | 4.80 | 0.4 | 4.7 | 50 | Comparison |
| 216 | ExY-2 | S-110 | 4.80 | 1.0 | 4.4 | 36 | Comparison |
| 217 | ExY-2 | S-201 | 6.45 | 0.4 | 4.9 | 52 | Comparison |
| 218 | ExY-2 | S-201 | 6.45 | 1.0 | 4.7 | 39 | Comparison |
| 219 | (1) | S-110 | 4.80 | 0.4 | 5.7 | 30 | Comparison |
| 220 | (1) | S-110 | 4.80 | 0.6 | 4.5 | 59 | Invention |
| 221 | (1) | S-110 | 4.80 | 0.8 | 4.0 | 72 | Invention |
| 222 | (1) | S-110 | 4.80 | 1.0 | 3.7 | 80 | Invention |
| 223 | (1) | S-110 | 4.80 | 1.5 | 3.5 | 84 | Invention |
| 224 | (1) | S-110 | 4.80 | 2.0 | 3.3 | 87 | Invention |
| 225 | (1) | S-201 | 6.45 | 0.4 | 6.3 | 25 | Comparison |
| 226 | (1) | S-201 | 6.45 | 0.6 | 5.8 | 53 | Invention |
| 227 | (1) | S-201 | 6.45 | 0.8 | 5.5 | 62 | Invention |
| 228 | (1) | S-201 | 6.45 | 1.0 | 5.3 | 70 | Invention |
| 229 | (1) | S-201 | 6.45 | 2.0 | 5.0 | 78 | Invention |
| 230 | (1) | S-601 | 13.45 | 0.4 | 7.4 | 42 | Comparison |
| 231 | (1) | S-601 | 13.45 | 0.6 | 7.2 | 62 | Invention |
| 232 | (1) | S-601 | 13.45 | 1.0 | 6.9 | 70 | Invention |
| 233 | (1) | S-601 | 13.45 | 2.0 | 6.7 | 73 | Invention |
| 234 | (1) | S-602 | 2.06 | 0.4 | 6.9 | 22 | Comparison |
| 235 | (1) | S-602 | 2.06 | 0.6 | 5.6 | 48 | Invention |
| 236 | (1) | S-602 | 2.06 | 1.0 | 5.2 | 57 | Invention |
| 237 | (1) | S-603 | 10.6 | 0.4 | 7.2 | 47 | Comparison |
| 238 | (1) | S-603 | 10.6 | 0.6 | 7.0 | 65 | Invention |
| 239 | (1) | S-603 | 10.6 | 1.0 | 6.8 | 71 | Invention |
| 240 | (2) | S-101 | 7.68 | 0.4 | 6.6 | 29 | Comparison |
| 241 | (2) | S-101 | 7.68 | 1.0 | 5.8 | 78 | Invention |
| 242 | (2) | S-102 | 7.33 | 0.4 | 6.4 | 31 | comparison |
| 243 | (2) | S-102 | 7.33 | 1.0 | 5.6 | 82 | Invention |
| 244 | (2) | S-104 | 6.64 | 0.4 | 6.3 | 37 | Comparison |
| 245 | (2) | S-104 | 6.64 | 1.0 | 5.4 | 86 | Invention |
| 246 | (2) | S-124 | 5.08 | 0.4 | 6.2 | 35 | Comparison |
| 247 | (2) | S-124 | 5.08 | 1.0 | 5.0 | 84 | Invention |
| 248 | (2) | S-109 | 5.86 | 0.4 | 6.2 | 32 | Comparison |
| 249 | (2) | S-109 | 5.86 | 1.0 | 4.5 | 81 | Invention |
| 250 | (2) | S-110 | 4.80 | 0.4 | 5.8 | 35 | Comparison |
| 251 | (2) | S-110 | 4.80 | 1.0 | 4.0 | 86 | Invention |
| 252 | (2) | S-111 | 4.46 | 0.4 | 5.9 | 37 | Comparison |
| 253 | (2) | S-111 | 4.46 | 1.0 | 4.1 | 89 | Invention |
| 254 | (2) | S-112 | 3.87 | 0.4 | 5.8 | 38 | Comparison |
| 255 | (2) | S-112 | 3.87 | 1.0 | 4.0 | 85 | Invention |
| 256 | (2) | S-201 | 6.45 | 0.4 | 6.6 | 28 | Comparison |
| 257 | (2) | S-201 | 6.45 | 1.0 | 5.8 | 75 | Invention |
| 258 | (2) | S-209 | 6.45 | 0.4 | 6.7 | 32 | Comparison |
| 259 | (2) | S-209 | 6.45 | 1.0 | 5.8 | 80 | Invention |
| 260 | (2) | S-203 | 5.18 | 0.4 | 6.2 | 30 | Comparison |
| 261 | (2) | S-203 | 5.18 | 1.0 | 5.0 | 77 | Invention |
| 262 | (2) | S-206 | 4.17 | 0.4 | 6.1 | 33 | Comparison |
| 263 | (2) | S-206 | 4.17 | 1.0 | 4.7 | 79 | Invention |
| 264 | (2) | S-301 | 4.49 | 0.4 | 6.1 | 30 | Comparison |
| 265 | (2) | S-301 | 4.49 | 1.0 | 4.6 | 76 | Invention |
| 266 | (2) | S-502 | 3.96 | 0.4 | 6.0 | 31 | Comparison |
| 267 | (2) | S-502 | 3.96 | 1.0 | 4.2 | 75 | Invention |
| 268 | (2) | S-407 | 3.84 | 0.4 | 6.0 | 33 | Comparison |
| 269 | (2) | S-407 | 3.84 | 1.0 | 4.2 | 74 | Invention |

The results shown in Table 3 reveal that coupler ExY-1 for comparison has a high $D_G/D_B$ value and has undesirable hue. This value does not largely vary, even if the amounts of the high boiling organic solvents are changed.

On the other hand, the results shown in Table 3 reveal that coupler ExY-2 for comparison shows a relatively low $D_G/D_B$ value, even when the amounts of the high boiling organic solvents used are small, and is superior to coupler ExY-1 in hue. However, even this coupler did not show the tendency of the hue to be further largely improved by increasing the amounts of the high boiling organic solvents.

Further, the results reveal that ExY-2 is inferior to ExY-1 in light fastness. Furthermore, it was observed that the couplers were both deteriorated in light fastness by increasing the amount of the high boiling organic solvent.

In contrast, with respect to the yellow couplers of the present invention, a greater effect of improving the hue (a drop in $D_G/D_B$ value) was observed by increasing the amounts of the high boiling organic solvents used. This tendency is pronounced at the high boiling organic solvents having a dielectric constant of 6.0 or less (for example, S-110, S-124, S-111, S-203 and S-206).

Further, this tendency is particularly pronounced with alkyl phosphates (for example, S-110 and S-111), which can be said to be the high boiling organic solvents preferable to improve the hue of the couplers of the present invention.

Furthermore, for any of the high boiling organic solvents, an improvement in light fastness is observed by increasing the amounts of the high boiling organic solvents used. Of the high boiling organic solvents, the solvents represented by general formulae (S-1) to (S-5) are highly effective.

EXAMPLE 3

A paper support, both sides of which were laminated with polyethylene, was subjected to corona discharge treatment and then provided with a gelatin underlayer containing sodium dodecylbenzenesulfonate. Various photographic constituent layers were further applied thereto. Thus, a multilayer color photographic paper sample 300 having the following layer constitution was prepared. Coating solutions were prepared as follows:

Preparation of Coating Solution for First Layer 132.0 g of yellow coupler (ExY), 15.0 g of color image stabilizer (Cpd-1), 7.5 g of color image stabilizer (Cpd-2) and 16.0 g of color image stabilizer (Cpd-3), were dissolved in 25 g of solvent (Solv-1), 25 g of solvent (Solv-2) and 180 cc of ethyl acetate. The resulting solution was emulsified and dispersed in 1000 g of a 10% aqueous solution of gelatin containing 60 cc of 10% sodium dodecylbenzenesulfonate and 10 g of citric acid, to prepare an emulsified dispersion A. This emulsified dispersion A and the silver chlorobromide emulsion prepared in Example 2 were mixed with each other to prepare a coating solution for a first layer so as to have the composition shown below. The amount of emulsion applied indicates a coated weight converted to silver.

Coating solutions for the second to seventh layers were prepared in the same manner as to the coating solution for the first layer. As a gelatin hardener for each layer, the sodium salt of 1-oxy-3,5-dichloro-s-triazine was used.

Cpd-14 and Cpd-15 were added to each layer to total amounts of 25.0 mg/m$^2$ and 50.0 mg/m$^2$, respectively.

In silver chlorobromide emulsions of other respective light-sensitive emulsion layers, the following color sensitizing dyes were used.

Sensitizing Dye C

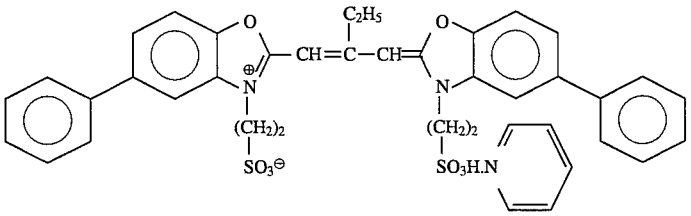

$4.0\times10^{-4}$ mol per mol of silver halide for a large-sized emulsion, and $5.6\times10^{-4}$ mol per mol of silver halide for a small-sized emulsion.

Sensitizing Dye D

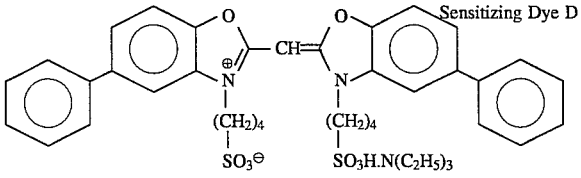

$7.0\times10^{-5}$ mol per mol of silver halide for a large-sized emulsion, and $1.0\times10^{-4}$ mol per mol of silver halide for a small-sized emulsion.

Red-Sensitive Emulsion Layer

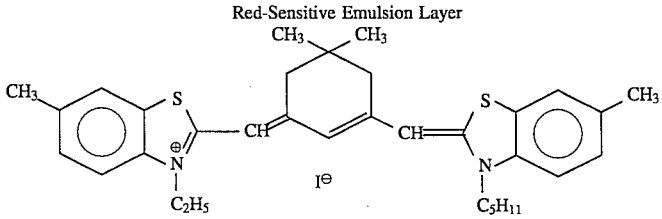

$0.9\times10^{-4}$ mol per mol of silver halide for a large-sized emulsion, and $1.1\times10^{-4}$ mol per mol of silver halide for a small-sized emulsion.

The following compound was further added in an amount of $2.6\times10^{-3}$ mol per mol of silver halide:

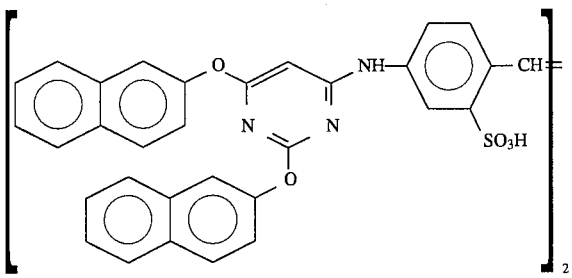

Further, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol per mol of silver halide, respectively.

The following dyes were added to the emulsion layers for prevention of irradiation. The numerical values in parentheses indicate coated weights.

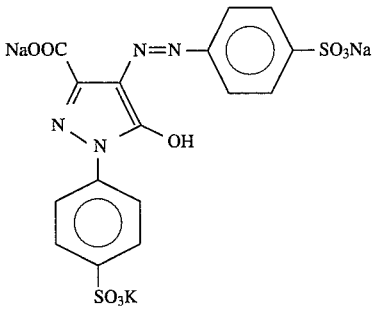

(10 mg/m²)

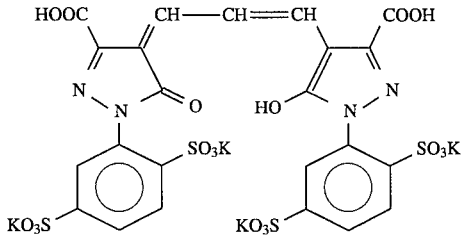

(10 mg/m²)

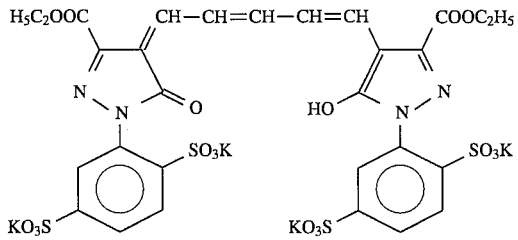

(40 mg/m²)

and

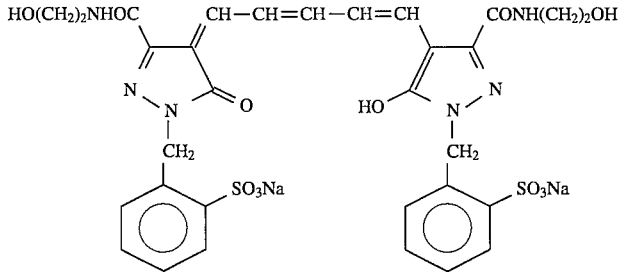

(20 mg/m²)

Layer Constitution

The composition of each layer is hereinafter shown. The numerals indicate coated weights ($g/m^2$). For the silver halide emulsions, the numerals indicate coated weights converted to silver.

Support

The support was paper laminated with polyethylene (polyethylene on the side of the first layer containing a white pigment ($TiO_2$) and a ,bluing dye (ultramarine)).

| | |
|---|---|
| First Layer (Blue-Sensitive Emulsion Layer) | |
| Silver Chlorobromide Emulsion | 0.27 |
| Described Above | |
| Gelatin | 1.36 |
| Yellow Coupler (ExY) | 0.68 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| Second Layer (Color Mixing Preventing Layer) | |
| Gelatin | 1.00 |
| Color Mixing Inhibitor (Cpd-4) | 0.08 |
| Solvent (Solv-7) | 0.03 |
| Solvent (Solv-2) | 0.25 |
| Solvent (Solv-3) | 0.25 |
| Third Layer (Green-Sensitive Emulsion Layer) | |
| Silver Chlorobromide Emulsion Cubic, a 1:3 mixture (Ag molar ratio) of a large-sized emulsion having a mean grain size of 0.55 μm and a small-sized emulsion having a mean grain size of 0.39 μm, coefficients of variation in grain size distribution being 0.1 and 0.08, respectively, each emulsion containing silver halide in which 0.8 mol % of AgBr is localized on part of the surface of each grain and the remainder being silver chloride. | 0.13 |
| Gelatin | 1.45 |
| Magenta Coupler (ExM) | 0.16 |
| Color Image Stabilizer (Cpd-5) | 0.15 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color Mixing Preventing Layer) | |
| Gelatin | 0.70 |
| Color Mixing Inhibitor (Cpd-4) | 0.05 |
| Solvent (Solv-7) | 0.02 |
| Solvent (Solv-2) | 0.18 |
| Solvent (Solv-3) | 0.18 |
| Fifth Layer (Red-Sensitive Emulsion Layer) | |
| Silver Chlorobromide Emulsion Cubic, a 1:4 mixture (Ag molar ratio) of a large-sized emulsion having a mean grain size of 0.50 μm and a small-sized emulsion having a mean grain size of 0.41 μm, coefficients of variation in grain size distribution being 0.09 and 0.11, respectively, each emulsion containing silver halide in which 0.8 mol % of AgBr is localized on part of the surface of each grain and the remainder being silver chloride. | 0.20 |
| Gelatin | 0.85 |
| Cyan Coupler (ExC) | 0.33 |
| Ultraviolet Light Absorber (UV-2) | 0.18 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-6) | 0.22 |
| Color Image Stabilizer (Cpd-8) | 0.01 |
| Color Image Stabilizer (Cpd-6) | 0.01 |
| Solvent (Solv-1) | 0.01 |
| Color Image Stabilizer (Cpd-1) | 0.33 |
| Sixth Layer (Ultraviolet Light Absorbing Layer) | |
| Gelatin | 0.55 |
| Ultraviolet Light Absorber (UV-1) | 0.38 |
| Color Image Stabilizer (Cpd-12) | 0.15 |
| Color Image Stabilizer (Cpd-5) | 0.02 |
| Seventh Layer (Protective Layer) | |
| Gelatin | 1.13 |
| Acrylic Modified Copolymer of Polyvinyl Alcohol (degree of modification: 17%) | 0.05 |

-continued
| | |
|---|---|
| Liquid paraffin | 0.02 |
| Color Image Stabilizer (Cpd-13) | 0.01 |
ExY Yellow Coupler:
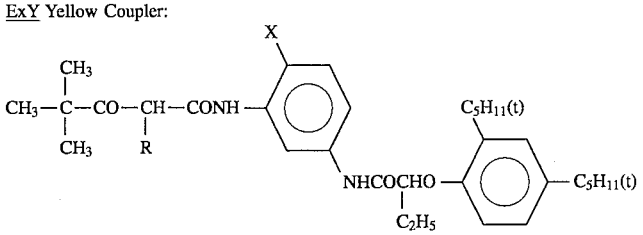
A 1:1 mixture (molar ratio) of
R = 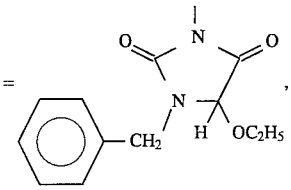 , X = Cl and R = 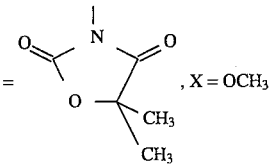 , X = $OCH_3$
ExM Magenta Coupler:
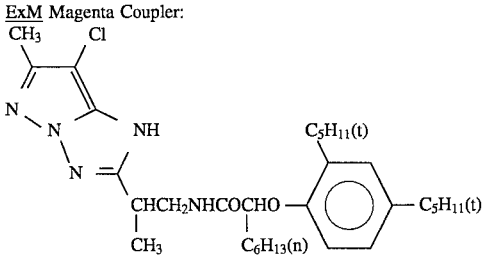
ExC Cyan Coupler:
A 3:7 mixture (molar ratio) of
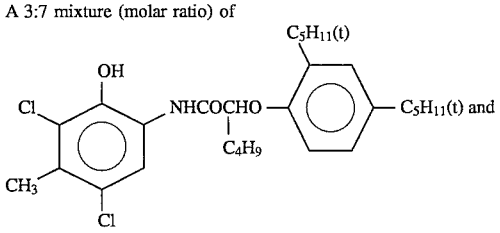
and
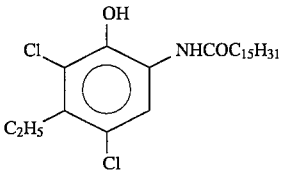
(Cpd-1) Color Image Stabilizer:
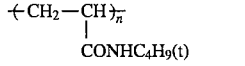
(average molecular weight: 60,000)
(Cpd-2) Color Image Stabilizer:
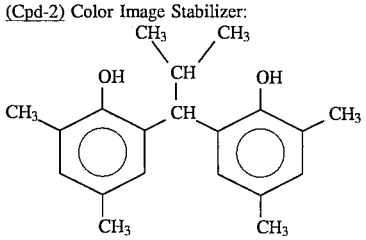
(Cpd-3) Color Image Stabilizer:
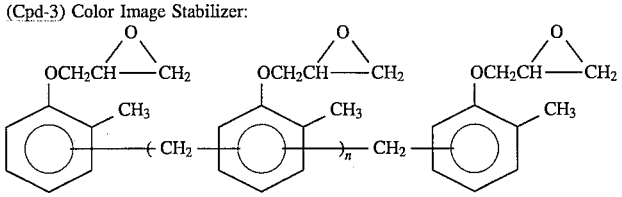
n = 7–8 (average value)

-continued
(Cpd-4) Color Mixing Inhibitor:
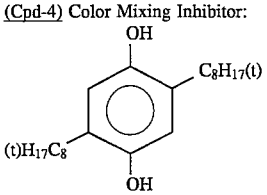
(Cpd-5) Color Image Stabilizer:
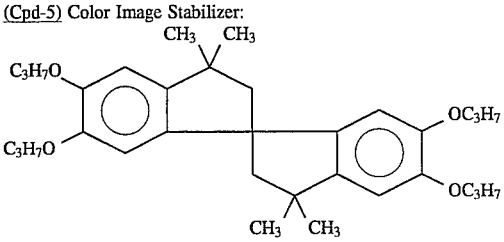
(Cpd-6) Color Image Stabilizer:
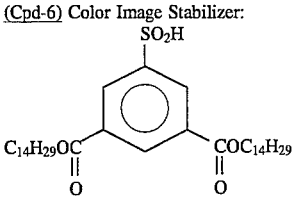
(Cpd-7) Color Image Stabilizer:
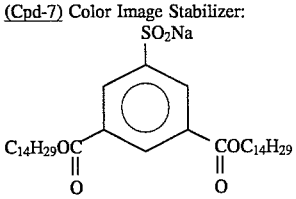
(Cpd-8) Color Image Stabilizer:
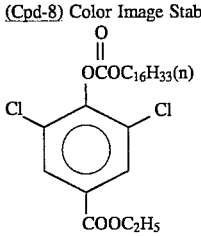
(Cpd-9) Color Image Stabilizer:
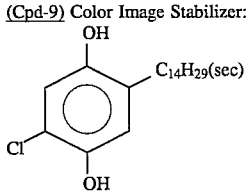
(Cpd-10) Color Image Stabilizer:
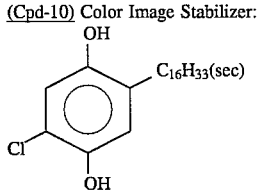
(Cpd-11) Color Image Stabilizer:

-continued
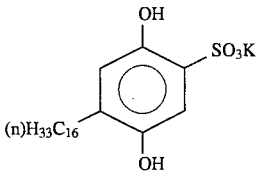
(Cpd-12) Color Image Stabilizer:
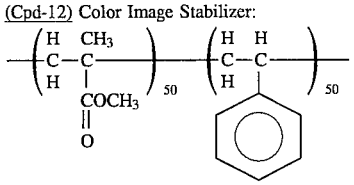
(average molecular weight: 60,000)
(Cpd-13) Color Image Stabilizer:
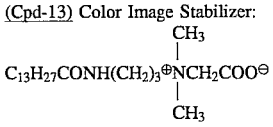
(Cpd-14) Antiseptic agent:
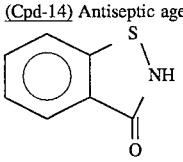
(Cpd-15) Antiseptic agent:
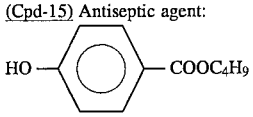
(UV-1) Ultraviolet Light Absorber
A 1:5:10:5 mixture (weight ratio) of (1), (2), (3) and (4).
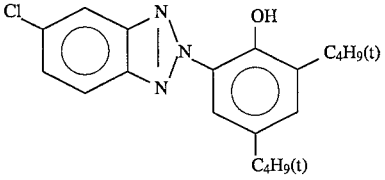
(1)
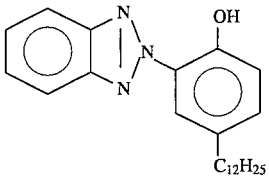
(2)
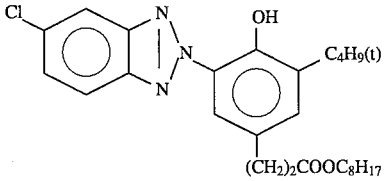
(3)
-continued
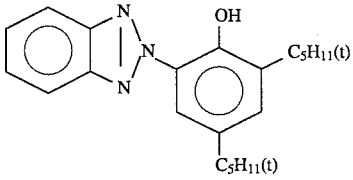
(4)
(UV-2) Ultraviolet Light Absorber
A 1:2:2 mixture (weight ratio) of (1), (2) and (3).
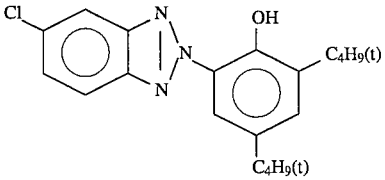
(1)
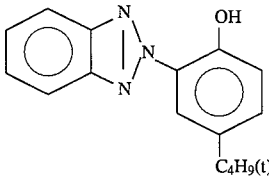
(2)

-continued (3)

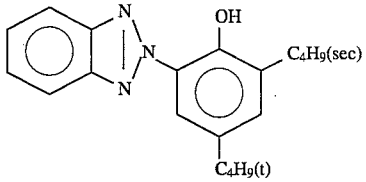

(Solv-1) Solvent:

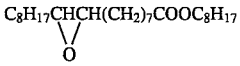

(Solv-2) Solvent:

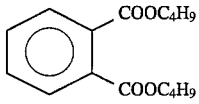

(Solv-3) Solvent:

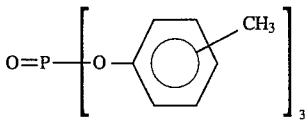

(Solv-4) Solvent:

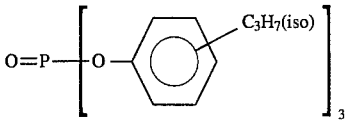

(Solv-5) Solvent:

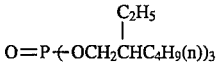

(Solv-6) Solvent:

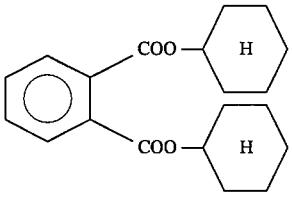

(Solv-7) Solvent:

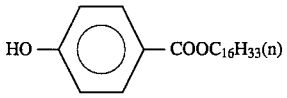

The above-described photographic material 300 was subjected to imagewise exposure using an optical wedge for three-color separation sensitometry. Then, continuous processing (running test) was carried out according to the following processing stages using a paper processor until the replenishment rate of the processing solutions reached twice the tank capacity of color development.

| Processing Stage | Temperature (°C.) | Time (sec) | Replenish-* ment Rate (ml) | Tank Capacity (liter) |
|---|---|---|---|---|
| Color Development | 35 | 45 | 161 | 10 |
| Bleach-Fixing | 35 | 45 | 218 | 10 |
| Rinsing (1) | 35 | 30 | — | 5 |
| Rinsing (2) | 35 | 30 | — | 5 |
| Rinsing (3) | 35 | 30 | 360 | 5 |
| Drying | 80 | 60 | | |

*Replenishment rate per $m^2$ of light-sensitive material

Three-tank countercurrent system from rinsing (3) to rinsing (1) was employed.

The composition of each processing solution was as follows:

| | Tank Solution | Replenisher |
|---|---|---|
| Color Developing Solution | | |
| Water | 800 ml | 800 ml |
| Ethylenediaminetetraacetic Acid | 3.0 g | 3.0 g |
| Disodium 4,5-Dihydroxy-benzene-1,3-disulfonate | 0.5 g | 0.5 g |
| Triethanolamine | 12.0 g | 12.0 g |
| Potassium Chloride | 2.5 g | — |
| Potassium Bromide | 0.01 g | — |
| Potassium Carbonate | 27.0 g | 27.0 g |
| Fluorescent Brightener (WHITEX 4, Sumitomo Chemical Co., Ltd.) | 1.0 g | 2.5 g |
| Sodium Sulfite | 0.1 g | 0.2 g |
| Disodium-N,N-bis(sulfonate-ethyl) hydroxylamine | 5.0 g | 8.0 g |
| N-Ethyl-N-(β-methanesulfon-amidoethyl)-3-methyl-4-aminoaniline.3/2 Sulfate. Monohydrate | 5.0 g | 7.1 g |
| Water to make | 1000 ml | 1000 ml |
| pH (25° C., with potassium hydroxide and sulfuric acid) | 10.05 | 10.45 |
| Bleach-Fixing Solution (tank solution and replenisher being the same) | | |
| Water | 600 ml | |
| Ammonium Thiosulfate (700 g/liter) | 100 ml | |
| Ammonium Sulfite | 40 g | |
| Ethylenediaminetetraacetic Acid Fe(III) Ammonium | 55 g | |
| Iron Ethylenediaminetetraacetate | 5 g | |
| Ammonium Bromide | 40 g | |
| Nitric Acid (67%) | 30 g | |
| Water to make | 1000 ml | |
| pH (25° C., with acetic acid and aqueous ammonia) | 5.8 | |
| Rinsing Solution (tank solution and replenisher being the same) | | |
| Chlorinated Sodium Isocyanurate | 0.02 g | |
| Deionized Water (electric conductivity: 5 μs/cm or less) | 1000 ml | |
| pH | 6.5 | |

Then, samples 301 to 385 were prepared in the same manner as with sample 300, with the exception that couplers, polymers (the amounts used are indicated by the percentages by weight to the couplers), and high boiling organic solvents (the amounts used are indicated by the weight ratios to the couplers) shown in Table 4 were substituted for yellow coupler (ExY), color image stabilizer (Cpd-1) and solvent (Solv-2), respectively.

Three sheets of each sample were exposed using an optical wedge for three-color separation sensitometry, followed by processing using processing solutions brought to a running state by use of the above-described sample 300. After processing, the yellow color forming density was measured for each sample through a blue color filter to prepare a sensitometry curve.

The yellow color forming density (Dmax) of each sample at exposure at which sample 300 gives a density of 2.20 (corresponding to the maximum color forming density), was read from the sensitometry curve, and the average values of three sheets are shown in Table 4 as evaluated values.

Then, one of the above-described sheets was irradiated with Xe light of 100,000 luxes (by intermittent irradiation of 3 hours in light/1 hour in the dark) for 28 days, and then the yellow density was measured again to determine the residual rate of color images. For the residual rate of color images, the residual rate at an initial density of 1.5 was indicated by percentage as an evaluated value of light fastness.

Further, another one of the above-described sheets was stored at 80° C. at a relative humidity of 70% for 28 days, and subsequently the residual rate of color images was determined in the same manner as described above as an evaluated value of dark fastness.

These evaluated values are shown in Table 4.

TABLE 4

| | | High Boiling Solvent | | Polymer | | Color Forming Property | Light Fading Xe | Dark Fading 80° C., 70% | |
|---|---|---|---|---|---|---|---|---|---|
| Sample | Coupler | Kind | Amount | Kind | Amount (%) | Dmax | 28 days (%) | 28 days (%) | Remark |
| 301 | ExY-1 | S-201 | 0.4 | — | — | 2.17 | 65 | 60 | Comparison |
| 302 | ExY-1 | S-201 | 0.6 | — | — | 2.22 | 61 | 62 | Comparison |
| 303 | ExY-1 | S-201 | 1.0 | — | — | 2.29 | 57 | 65 | Comparison |
| 304 | ExY-1 | S-201 | 0.4 | P-17 | 10 | 2.08 | 76 | 62 | Comparison |
| 305 | ExY-1 | S-201 | 0.4 | P-17 | 20 | 1.68 | 80 | 63 | Comparison |
| 306 | ExY-1 | S-201 | 0.6 | P-17 | 10 | 2.14 | 71 | 64 | Comparison |
| 307 | ExY-1 | S-201 | 0.6 | P-17 | 20 | 1.75 | 75 | 64 | Comparison |
| 308 | ExY-1 | S-201 | 1.0 | P-17 | 10 | 2.21 | 67 | 67 | Comparison |
| 309 | ExY-1 | S-201 | 1.0 | P-17 | 20 | 2.08 | 71 | 68 | Comparison |
| 310 | ExY-1 | S-201 | 1.0 | P-17 | 30 | 1.92 | 74 | 68 | Comparison |
| 311 | ExY-1 | S-201 | 1.0 | P-17 | 50 | 1.74 | 78 | 69 | Comparison |
| 312 | ExY-2 | S-110 | 0.4 | — | — | 2.04 | 65 | 65 | Comparison |
| 313 | ExY-2 | S-110 | 1.0 | — | — | 2.32 | 52 | 68 | Comparison |
| 314 | ExY-2 | S-110 | 0.4 | P-17 | 10 | 1.87 | 73 | 68 | Comparison |
| 315 | ExY-2 | S-110 | 0.4 | P-17 | 20 | 1.58 | 77 | 69 | Comparison |
| 316 | ExY-2 | S-110 | 1.0 | P-17 | 10 | 2.24 | 64 | 70 | Comparison |
| 317 | ExY-2 | S-110 | 1.0 | P-17 | 20 | 1.73 | 68 | 71 | Comparison |
| 318 | (2) | S-201 | 0.4 | — | — | 2.25 | 48 | 87 | Comparison |
| 319 | (2) | S-201 | 0.6 | — | — | 2.27 | 67 | 90 | Invention |
| 320 | (2) | S-201 | 1.0 | — | — | 2.28 | 75 | 92 | Invention |
| 321 | (2) | S-201 | 0.4 | P-17 | 10 | 2.24 | 55 | 89 | Comparison |
| 322 | (2) | S-201 | 0.4 | P-17 | 20 | 2.24 | 57 | 89 | Comparison |
| 323 | (2) | S-201 | 0.4 | P-17 | 50 | 2.17 | 60 | 90 | Comparison |
| 324 | (2) | S-201 | 0.6 | P-17 | 10 | 2.26 | 74 | 92 | Invention |
| 325 | (2) | S-201 | 0.6 | P-17 | 20 | 2.25 | 83 | 92 | Invention |
| 326 | (2) | S-201 | 0.6 | P-17 | 50 | 2.21 | 88 | 93 | Invention |
| 327 | (2) | S-201 | 1.0 | P-17 | 20 | 2.27 | 88 | 94 | Invention |
| 328 | (2) | S-201 | 1.0 | P-17 | 50 | 2.27 | 90 | 95 | Invention |
| 329 | (2) | S-201 | 1.0 | P-17 | 100 | 2.24 | 92 | 96 | Invention |
| 330 | (2) | S-201 | 0.4 | P-2 | 20 | 2.24 | 56 | 89 | Comparison |
| 331 | (2) | S-201 | 1.0 | P-2 | 20 | 2.26 | 85 | 94 | Invention |
| 332 | (2) | S-201 | 0.4 | P-70 | 20 | 2.23 | 54 | 87 | Comparison |
| 333 | (2) | S-201 | 1.0 | P-70 | 20 | 2.25 | 82 | 92 | Invention |
| 334 | (2) | S-110 | 0.4 | — | — | 2.23 | 55 | 90 | Comparison |
| 335 | (2) | S-110 | 0.6 | — | — | 2.25 | 72 | 92 | Invention |
| 336 | (2) | S-110 | 1.0 | — | — | 2.25 | 81 | 93 | Invention |
| 337 | (2) | S-110 | 0.4 | P-17 | 10 | 2.23 | 62 | 92 | Comparison |
| 338 | (2) | S-110 | 0.4 | P-17 | 20 | 2.23 | 64 | 93 | Comparison |
| 339 | (2) | S-110 | 0.4 | P-17 | 50 | 2.21 | 66 | 94 | Comparison |
| 340 | (2) | S-110 | 1.0 | P-17 | 20 | 2.25 | 86 | 94 | Invention |
| 341 | (2) | S-110 | 1.0 | P-17 | 50 | 2.25 | 90 | 95 | Invention |
| 342 | (2) | S-110 | 1.0 | P-17 | 100 | 2.24 | 95 | 97 | Invention |
| 343 | (2) | S-102 | 0.4 | — | — | 2.25 | 53 | 88 | Comparison |
| 344 | (2) | S-102 | 0.6 | — | — | 2.27 | 70 | 91 | Invention |
| 345 | (2) | S-102 | 1.0 | — | — | 2.28 | 78 | 92 | Invention |
| 346 | (2) | S-102 | 0.4 | P-67 | 10 | 2.25 | 59 | 90 | Comparison |
| 347 | (2) | S-102 | 0.4 | P-67 | 20 | 2.24 | 62 | 91 | Comparison |
| 348 | (2) | S-102 | 0.4 | P-67 | 50 | 2.22 | 64 | 91 | Comparison |
| 349 | (2) | S-102 | 1.0 | P-67 | 20 | 2.28 | 82 | 93 | Invention |
| 350 | (2) | S-102 | 1.0 | P-67 | 50 | 2.27 | 88 | 93 | Invention |
| 351 | (2) | S-102 | 1.0 | P-67 | 100 | 2.25 | 94 | 94 | Invention |
| 352 | (1) | S-111 | 0.4 | — | — | 2.19 | 49 | 88 | Comparison |
| 353 | (1) | S-111 | 0.6 | — | — | 2.21 | 68 | 90 | Invention |
| 354 | (1) | S-111 | 1.0 | — | — | 2.22 | 79 | 91 | Invention |
| 355 | (1) | S-111 | 0.4 | P-17 | 20 | 2.18 | 56 | 89 | Comparison |
| 356 | (1) | S-111 | 0.6 | P-17 | 20 | 2.20 | 75 | 90 | Invention |
| 357 | (1) | S-111 | 1.0 | P-17 | 20 | 2.22 | 86 | 92 | Invention |
| 358 | (1) | S-203 | 0.4 | — | — | 2.21 | 50 | 90 | Comparison |
| 359 | (1) | S-203 | 0.6 | — | — | 2.23 | 69 | 93 | Invention |
| 360 | (1) | S-203 | 1.0 | — | — | 2.24 | 81 | 95 | Invention |
| 361 | (1) | S-203 | 0.4 | P-67 | 20 | 2.20 | 58 | 93 | Comparison |
| 362 | (1) | S-203 | 0.6 | P-67 | 20 | 2.23 | 78 | 95 | Invention |

TABLE 4-continued

| Sample | Coupler | High Boiling Solvent Kind | High Boiling Solvent Amount | Polymer Kind | Polymer Amount (%) | Color Forming Property Dmax | Light Fading Xe 28 days (%) | Dark Fading 80° C., 70% 28 days (%) | Remark |
|---|---|---|---|---|---|---|---|---|---|
| 363 | (1) | S-203 | 1.0 | P-67 | 20 | 2.24 | 89 | 97 | Invention |
| 364 | (1) | S-203 | 1.0 | P-67 | 50 | 2.21 | 92 | 98 | Invention |
| 365 | (29) | S-110 | 0.4 | — | — | 2.24 | 45 | 85 | Comparison |
| 366 | (29) | S-110 | 0.6 | — | — | 2.27 | 68 | 90 | Invention |
| 367 | (29) | S-110 | 1.0 | — | — | 2.28 | 80 | 92 | Invention |
| 368 | (29) | S-110 | 0.4 | P-17 | 20 | 2.20 | 52 | 89 | Comparison |
| 369 | (29) | S-110 | 0.6 | P-17 | 20 | 2.25 | 74 | 92 | Invention |
| 370 | (29) | S-110 | 1.0 | P-17 | 20 | 2.27 | 86 | 94 | Invention |
| 371 | (29) | S-110 | 1.0 | P-17 | 50 | 2.24 | 91 | 96 | Invention |
| 372 | (8) | S-110 | 0.4 | — | — | 2.18 | 43 | 88 | Comparison |
| 373 | (8) | S-110 | 0.6 | — | — | 2.20 | 69 | 90 | Invention |
| 374 | (8) | S-110 | 1.0 | — | — | 2.21 | 82 | 90 | Invention |
| 375 | (8) | S-110 | 0.4 | P-17 | 20 | 2.16 | 53 | 91 | Comparison |
| 376 | (8) | S-110 | 0.6 | P-17 | 20 | 2.20 | 75 | 93 | Invention |
| 377 | (8) | S-110 | 1.0 | P-17 | 20 | 2.21 | 84 | 94 | Invention |
| 378 | (8) | S-110 | 2.0 | P-17 | 100 | 2.21 | 93 | 96 | Invention |
| 379 | (15) | S-110 | 0.4 | — | — | 2.08 | 35 | 91 | Comparison |
| 380 | (15) | S-110 | 0.6 | — | — | 2.14 | 62 | 93 | Invention |
| 381 | (15) | S-110 | 1.0 | — | — | 2.18 | 85 | 94 | Invention |
| 382 | (15) | S-110 | 0.4 | P-17 | 20 | 2.01 | 48 | 92 | Comparison |
| 383 | (15) | S-110 | 0.6 | P-17 | 20 | 2.10 | 75 | 95 | Invention |
| 384 | (15) | S-110 | 1.0 | P-17 | 20 | 2.17 | 91 | 95 | Invention |
| 385 | (15) | S-110 | 2.0 | P-17 | 50 | 2.16 | 94 | 96 | Invention |

The results shown in Table 4 reveal that the yellow couplers of the present invention are significantly improved in light fastness when the high boiling organic solvents are used in weight ratios to the couplers of 0.6 or more, as shown in Examples 1 and 2.

Even when each of the polymers is added to coupler ExY-1 for comparison, the light fastness is improved. However, although this effect increases with increasing the amount of the polymer added, a reduction in color forming property is induced at the same time. Accordingly, when the couplers for comparison are used, the amount of the polymer which can be added for an improvement in light fading has a limitation.

On the other hand, the light fastness is also improved by adding the polymers to the couplers of the present invention. When the high boiling organic solvents are used in amounts to the couplers of less than 0.6, the level of the light fastness of the coupler for comparison is not reached. However, when the high boiling organic solvents are used in weight ratios to the couplers of 0.6 or more, a light fastness equivalent to or higher than that of the coupler for comparison is attained. Further increases in the amounts of the polymers cause the realization of a higher light fastness without lowering the color forming property.

Further, the same samples as described above were processed by use of the above-described processing stages, and running processing was continued until the replenishment rate of the developing solution reached 5 times the tank capacity, followed by evaluations in the same manner as to those described above. The results thereof revealed that the samples of the present invention had a lower drop in the maximum color forming density than the samples for comparison. This shows that the samples of the present invention are excellent because of little processing dependency.

Furthermore, the results shown in Table 4 reveal that significant improvements in color image fastness in the dark also become possible by using the yellow couplers of the present invention.

EXAMPLE 4

Samples were prepared in the same manner as with Example 3, with the exception that HP-5, BP-14 or BP-15 was substituted for color image stabilizer (Cpd-2) in the blue-sensitive emulsion layer of each sample of Example 3. These samples were also evaluated in the same manner as with Example 3.

Also in this case, the couplers of the present invention were confirmed to show a particularly high light fastness when the high boiling organic solvents were used in weight ratios to the couplers of 0.6 or more.

As has been described in the foregoing Examples 1 to 4, it becomes possible to provide the photographic materials excellent in color reproducibility, color forming property, color image fastness and processing dependency by using the couplers of the present invention with the high boiling organic solvents which are used in weight ratios to the couplers of 0.6 or more.

In particular, the color image fastness can be more improved by using the polymers in amounts of 20% by weight or more based on the couplers.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising, on a support, at least one cyan color forming silver halide emulsion layer, at least one magenta color forming silver halide emulsion layer and at least one yellow color forming silver halide emulsion layer, which differ from one another in color sensitivity, wherein a yellow color forming silver halide emulsion layer comprises a water-insoluble polymer and at least one yellow color forming coupler represented by the following formula (I) dispersed by dissolution in a high boiling organic solvent in a weight ratio of the high boiling organic solvent to the yellow color forming coupler of 1.0 to 3.0:

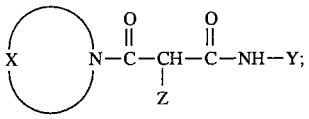

(I)

wherein X represents an organic residue necessary for forming a nitrogen-containing heterocycle with a nitrogen atom; Y represents an aromatic group or a heterocyclic group; Z represents a group which is eliminatable by reaction of the coupler represented by formula (I) with an oxidation product of a developing agent, wherein the weight ratio of water-insoluble polymer to said at least one yellow coupler of formula (I) is 0.02 to 2.0, and wherein said high boiling organic solvent is represented by the following general formula (S-1):

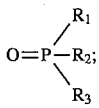

(S-1)

wherein $R_1$, $R_2$ and $R_3$, which may be the same or different, each represent an alkyl group, a cycloalkyl group, an aryl group, an alkoxy group, a cycloalkyloxy group or an aryloxy group.

2. A silver halide color photographic material according to claim 1, wherein the yellow color forming coupler is selected from those represented by formula

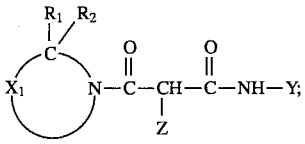

(II)

wherein Y and Z have the same meaning as Y and Z of formula (I); $X_1$ represents an organic residue necessary for forming a nitrogen-containing heterocycle with —C($R_1R_2$)—N—; and $R_1$ and $R_2$ each represents a hydrogen atom or a substituent.

3. A silver halide color photographic material according to claim 17, wherein the yellow color forming coupler is selected from those represented by formula

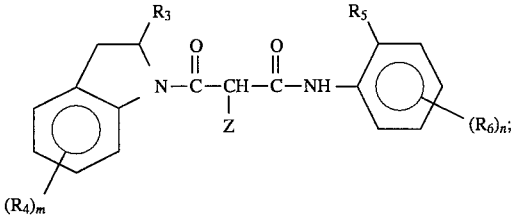

(III)

wherein $R_3$ represents a hydrogen atom or a substituent; $R_4$, $R_5$ and $R_6$ represent substituents; Z has the same meaning as in general formula (I); m and n each represent an integer of 0 to 4; with the proviso that when m and n each represent an integer of 2 or more, $R_4$ and $R_6$, which may be the same or different, may combine to form a ring.

4. A silver halide color photographic material comprising a yellow color forming silver halide emulsion layer formed on a support, said layer containing at least one yellow color forming coupler dispersed by dissolution in a high boiling organic solvent in a weight ratio of high boiling organic solvent to yellow color forming coupler of 1.0 to 3.0, wherein said yellow forming coupler is represented by the following formula (I):

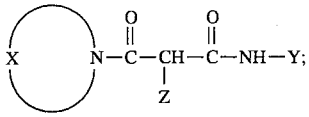

(I)

wherein X represents an organic residue necessary for forming a nitrogen-containing heterocycle with a nitrogen atom; Y represents an aromatic group or a heterocyclic group; Z represents a group which is eliminatable by reaction of the coupler represented by formula (I) with an oxidation product of a developing agent, and wherein said high boiling point organic solvent is represented by the following general formula (S-I):

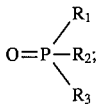

(S-1)

wherein $R_1$, $R_2$, $R_3$, which may be the same or different, each represent an alkyl group, a cycloalkyl group, an aryl group, an alkoxy group, a cycloalkyloxy group or an aryloxy group.

5. A silver halide color photographic material according to claim 4, wherein said yellow color forming silver halide emulsion layer further comprises a water-insoluble polymer.

6. A silver halide color photographic material according to claim 5, wherein said yellow color forming silver halide emulsion layer further comprises a hindered phenol represented by the following general formula (IV) or a bisphenol represented by the following general formula (V).

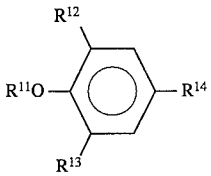

(IV)

wherein $R^{11}$ represents hydrogen atom, an alkyl group, an alkenyl group, an aryl group, an allyl group, an acyl group or a silyl group; and $R^{12}$ and $R^{13}$ are straight or branched alkyl groups of 3 to 8 carbon atoms, which are bonded preferably through secondary or tertiary carbon, more preferably through tertiary carbon;

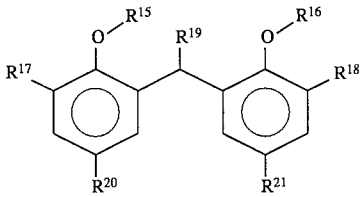

(V)

wherein $R^{15}$ and $R^{16}$ each independently represents a hydrogen atom, an alkyl group, an alkenyl group, an aryl group, an allyl group, an acyl group, a phosphonyl group, a phosphinyl group or a sulfonyl group, and $R^{15}$ and $R^{16}$ may combine through the above-described group to form a ring; $R^{17}$, $R^{18}$, $R^{20}$ and $R^{21}$ represent straight or branched alkyl groups of 1 to 8 carbon atoms; $R^{19}$ is a hydrogen atom or a straight or branched alkyl group of 1 to 8 carbon atoms.

7. A silver halide color photographic material according to claim 5, wherein the weight ratio of the water-insoluble polymer to said yellow coupler in said yellow color forming silver halide emulsion layer is 0.02 or more.

8. A silver halide color photographic material according to claim 7, comprising the water-insoluble polymer in a weight ratio to yellow coupler of 0.02 to 2.0.

9. A silver halide color photographic material according to claim 5, wherein the water-insoluble polymer is a vinyl polymer where the repeating units have —(C=O)— linkages, or a water-insoluble polyester.

10. A silver halide color photographic material according to claim 4, wherein the yellow color forming coupler is selected from those represented by formula (II):

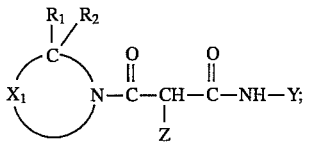

(II)

wherein Y and Z have the same meaning as Y and Z of formula (I); $X_1$ represents an organic residue necessary for forming a nitrogen-containing heterocycle with —C($R_1R_2$)—N—; and $R_1$ and $R_2$ each represents a hydrogen atom or a substituent.

11. A silver halide color photographic material according to claim 10, wherein the yellow forming coupler is selected from those represented by formula (III):

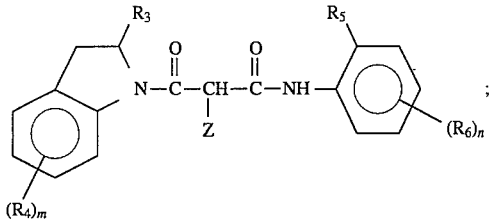

(III)

wherein $R_3$ represents a hydrogen atom or a substituent; $R_4$, $R_5$ and $R_6$ represent substituents; Z has the same meaning as in general formula (I); m and n each represent an integer of 0 to 4; with the proviso that when m and n each represent an integer of 2 or more, $R_4$ and $R^6$, which may be the same or different, may combine to form a ring.

12. A silver halide color photographic material according to claim 4, further comprising, on the support, at least one cyan color forming silver halide emulsion layer, and at least one magenta color forming silver halide emulsion layer wherein the cyan layer, magenta layer and the yellow color forming silver halide emulsion layer are different from one another in color sensitivity.

13. A silver halide color photographic material according to claim 4, wherein said silver halide emulsion layer comprises silver chloride or silver chlorobromide substantially free from silver iodide and containing 90 mol % or more of silver chloride.

* * * * *